US012161197B2

(12) United States Patent
Schneider et al.

(10) Patent No.: US 12,161,197 B2
(45) **Date of Patent: *Dec. 10, 2024**

(54) LACING ARCHITECTURE FOR AUTOMATED FOOTWEAR PLATFORM

(71) Applicant: NIKE, Inc., Beaverton, OR (US)

(72) Inventors: Summer L. Schneider, Beaverton, OR (US); Narissa Chang, Portland, OR (US); Daniel A. Johnson, Portland, OR (US); Peter R. Savage, Aloha, OR (US); Travis J. Berrian, Beaverton, OR (US); Fanny Yung Ho, Portland, OR (US); Eric P. Avar, Lake Oswego, OR (US); Elizabeth A. Kilgore, Portland, OR (US); Katelyn Ricciardi, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/866,887

(22) Filed: Jul. 18, 2022

(65) Prior Publication Data

US 2022/0395062 A1 Dec. 15, 2022

Related U.S. Application Data

(60) Division of application No. 16/715,212, filed on Dec. 16, 2019, now Pat. No. 11,388,955, which is a (Continued)

(51) Int. Cl.
*A43C 11/16* (2006.01)
*A43B 3/34* (2022.01)
(Continued)

(52) U.S. Cl.
CPC ..... *A43C 11/008* (2013.01); *A43B 3/34* (2022.01); *A43B 13/14* (2013.01);
(Continued)

(58) Field of Classification Search
None
See application file for complete search history.

(56) References Cited

U.S. PATENT DOCUMENTS 1,412,486 A * 4/1922 Paine ..... A43C 1/00 24/713.6
1,862,047 A 6/1932 Boulet et al.
(Continued)

FOREIGN PATENT DOCUMENTS

CN 2060632 8/1990
CN 1047797 12/1990
(Continued)

OTHER PUBLICATIONS

"European Application Serial No. 22189649.1, Extended European Search Report mailed Oct. 17, 2022", 8 pgs.
(Continued)

*Primary Examiner* — Jila M Mohandesi
(74) *Attorney, Agent, or Firm* — Schwegman, Lundberg & Woessner, P.A.

(57) ABSTRACT

Systems and apparatus related to footwear including a modular lacing engine are discussed. In this example, the footwear assembly can include a footwear upper and a lace cable running through a plurality of lace guides. The plurality of lace guides can be distributed along the medial side and the lateral side, and each lace guide of the plurality of lace guides can be adapted to receive a length of the lace cable. The lace cable can extend through each of the plurality of lace guides to form a pattern along each of the medial side and lateral side of the footwear upper. The footwear assembly can also include a medial proximal lace guide routing the lace cable into a lacing engine disposed
(Continued)

within a mid-sole portion. Finally, the footwear assembly includes a lateral proximal lace guide to route the lace cable out of the lacing engine.

20 Claims, 18 Drawing Sheets

Related U.S. Application Data continuation of application No. 15/458,816, filed on Mar. 14, 2017, now Pat. No. 10,537,155.

(60) Provisional application No. 62/424,294, filed on Nov. 18, 2016, provisional application No. 62/413,142, filed on Oct. 26, 2016.

(51) Int. Cl.

| | |
|---|---|
| ***A43B 13/14*** | (2006.01) |
| ***A43B 23/02*** | (2006.01) |
| ***A43C 1/00*** | (2006.01) |
| ***A43C 1/06*** | (2006.01) |
| ***A43C 11/00*** | (2006.01) |
| ***A43C 11/12*** | (2006.01) |

(52) U.S. Cl.

CPC ..... *A43B 23/0245* (2013.01); *A43C 1/00* (2013.01); *A43C 1/06* (2013.01); *A43C 11/12* (2013.01); *A43C 11/165* (2013.01); *Y10T 24/3734* (2015.01); *Y10T 24/3737* (2015.01); *Y10T 24/3742* (2015.01)

(56) References Cited

U.S. PATENT DOCUMENTS

| | | | | |
|---|---|---|---|---|
| 2,109,751 | A * | 3/1938 | Eugen | A43B 5/0486 36/99 |
| 3,491,465 | A * | 1/1970 | Martin | A43C 11/008 D2/904 |
| 3,848,347 | A | 11/1974 | Hanson et al. | |
| 4,142,307 | A * | 3/1979 | Martin | A43C 11/1486 36/118.2 |
| 4,451,995 | A | 6/1984 | Antonious | |
| 4,937,952 | A * | 7/1990 | Olivieri | A43C 11/16 36/118.9 |
| 4,937,953 | A * | 7/1990 | Walkhoff | A43C 11/165 36/117.7 |
| 5,117,567 | A * | 6/1992 | Berger | A43C 11/16 36/50.1 |
| 5,797,200 | A | 8/1998 | Hess et al. | |
| 5,983,530 | A | 11/1999 | Chou | |
| 6,324,774 | B1 | 12/2001 | Zebe, Jr. | |
| 6,922,917 | B2 * | 8/2005 | Kerns | A43B 5/14 36/50.1 |
| 7,096,559 | B2 | 8/2006 | Johnson | |
| 7,281,341 | B2 | 10/2007 | Reagan et al. | |
| 7,841,106 | B2 | 11/2010 | Farys | |
| 8,474,157 | B2 | 7/2013 | Motawi et al. | |
| 8,713,820 | B2 | 5/2014 | Kerns et al. | |
| 8,858,482 | B2 * | 10/2014 | Ingimundarson | A61F 5/0123 128/882 |
| 9,907,360 | B2 | 3/2018 | Foster et al. | |
| 11,388,955 | B2 | 7/2022 | Schneider et al. | |
| 2003/0204938 | A1 | 11/2003 | Hammerslag | |
| 2007/0068040 | A1 | 3/2007 | Farys | |
| 2008/0307673 | A1 | 12/2008 | Johnson | |
| 2011/0225843 | A1 | 9/2011 | Kers et al. | |
| 2012/0240428 | A1 * | 9/2012 | Knoll | A43B 5/0427 36/50.1 |
| 2013/0086816 | A1 | 4/2013 | Johnson et al. | |
| 2015/0059206 | A1 | 3/2015 | Lovett et al. | |
| 2015/0096202 | A1 | 4/2015 | Hahnenberger et al. | |
| 2015/0289595 | A1 | 10/2015 | Rushbrook et al. | |
| 2016/0198803 | A1 | 7/2016 | Soderberg et al. | |
| 2016/0213099 | A1 | 7/2016 | Ha | |
| 2018/0110298 | A1 | 4/2018 | Schneider et al. | |
| 2018/0289110 | A1 | 10/2018 | Bock et al. | |
| 2018/0368526 | A1 | 12/2018 | Bock et al. | |
| 2020/0187597 | A1 | 6/2020 | Schneider et al. | |

FOREIGN PATENT DOCUMENTS

| | | |
|---|---|---|
| CN | 2624673 | 7/2004 |
| CN | 1694630 | 11/2005 |
| CN | 2779913 | 5/2006 |
| CN | 101784210 | 7/2010 |
| CN | 203028266 | 7/2013 |
| CN | 104023579 | 9/2014 |
| CN | 105517459 | 4/2016 |
| CN | 110099584 | 8/2019 |
| CN | 114145545 | 3/2022 |
| DE | 202010001717 | 6/2010 |
| EP | 3531857 | 8/2022 |
| JP | H0327183 | 2/1991 |
| JP | 2001197905 | 7/2001 |
| JP | 2006502797 | 1/2006 |
| JP | 5782665 | 7/2015 |
| JP | 2016530058 | 9/2016 |
| JP | 2019535375 | 12/2019 |
| JP | 6728494 | 7/2020 |
| JP | 2020168430 | 10/2020 |
| JP | 7145911 | 9/2022 |
| JP | 2022160424 | 10/2022 |
| JP | 7408732 B2 | 1/2024 |
| JP | 2024029044 | 3/2024 |
| KR | 19930701932 | 9/1993 |
| KR | 19937001932 | 9/1993 |
| KR | 20030025283 | 3/2003 |
| KR | 200480235 | 4/2016 |
| KR | 20200111289 | 9/2020 |
| KR | 102220090 | 2/2021 |
| KR | 20210021609 | 2/2021 |
| KR | 102360545 | 2/2022 |
| WO | 2009071652 | 6/2009 |
| WO | 2018080580 | 5/2018 |

OTHER PUBLICATIONS

"International Application Serial No. PCT US2017 022338, International Search Report mailed Jul. 24, 2017", 4 pgs.

"International Application Serial No. PCT US2017 022338, Written Opinion mailed Jul. 24, 2017", 5 pgs.

"U.S. Appl. No. 15/458,816, Restriction Requirement mailed Nov. 30, 2018", 9 pgs.

"U.S. Appl. No. 15/458,816, Response filed Jan. 30, 2019 to Restriction Requirement mailed Nov. 30, 2018", 7 pgs.

"U.S. Appl. No. 15/458,816, Non Final Office Action mailed Apr. 10, 2019", 10 pgs.

"International Application Serial No. PCT US2017 022338, International Preliminary Report on Patentability mailed May 9, 2019", 7 pgs.

"U.S. Appl. No. 15/458,816, Response filed Jul. 16, 2019 to Non Final Office Action mailed Apr. 10, 2019", 9 pgs.

"U.S. Appl. No. 15/458,816, Notice of Allowance mailed Sep. 11, 2019", 8 pgs.

"Chinese Application Serial No. 201780079477.5, Voluntary Amendment and PPH Request filed Feb. 14, 2020", w English claims, 15 pgs.

"European Application Serial No. 17863859.9, Response to Communication Pursuant to Rules 161 and 162 filed Dec. 10, 2019", 12 pgs.

"U.S. Appl. No. 16/715,212, Preliminary Amendment filed Mar. 9, 2020", 9 pgs.

"Korean Application Serial No. 10-2019-7014538, Voluntary Amendment filed Mar. 6, 2020", w English claims, 14 pgs.

"Japanese Application Serial No. 2019-522690, Voluntary Amendment filed Mar. 10, 2020", w English claims, 12 pgs.

(56) References Cited

OTHER PUBLICATIONS

"European Application Serial No. 17863859.9, Extended European Search Report mailed Apr. 20, 2020", 8 pgs.
"Chinese Application Serial No. 201780079477.5, Office Action mailed Apr. 9, 2020", w English translation, 12 pgs.
"Japanese Application Serial No. 2020-114434, Voluntary Amendment filed Jul. 29, 2020", w English claims, 7 pgs.
"European Application Serial No. 17863859.9, Response filed Nov. 9, 2020 to Extended European Search Report mailed Apr. 20, 2020", 15 pgs.
"Chinese Application Serial No. 201780079477.5, Response filed Oct. 26, 2020 to Office Action mailed Apr. 9, 2020", w English claims, 16 pgs.
"Chinese Application Serial No. 201780079477.5, Office Action mailed Dec. 31, 2020", With English translation, 21 pgs.
"European Application Serial No. 17863859.9, Communication Pursuant to Article 94(3) EPC mailed Mar. 31, 2021", 7 pgs.
"U.S. Appl. No. 16/715,212, Restriction Requirement mailed Apr. 12, 2021", 10 pgs.
"Korean Application Serial No. 10-2021-7004942, Office Action mailed Apr. 22, 2021", w English translation, 8 pgs.
"Chinese Application Serial No. 201780079477.5, Response filed May 17, 2021 to Office Action mailed Dec. 31, 2020", w English claims, 18 pgs.
"U.S. Appl. No. 16/715,212, Response filed Aug. 11, 2021 to Restriction Requirement mailed Apr. 12, 2021", 7 pgs.
"European Application Serial No. 17863859.9, Response filed Jul. 27, 2021 to Communication Pursuant to Article 94(3) EPC mailed Mar. 31, 2021", 24 pgs.
"Japanese Application Serial No. 2020-114434, Notification of Reasons for Refusal mailed Aug. 24, 2021", w English translation, 9 pgs.
"Chinese Application Serial No. 201780079477.5, Response to Examiner Telephone Interview filed Aug. 16, 2021", w English claims, 7 pgs.
"U.S. Appl. No. 16/715,212, Non Final Office Action mailed Sep. 21, 2021", 11 pgs.
"Korean Application Serial No. 10-2021-7004942, Response filed Oct. 22, 2021 to Office Action mailed Apr. 22, 2021", w English claims, 18 pgs.
"U.S. Appl. No. 16/715,212, Examiner Interview Summary mailed Dec. 13, 2021", 2 pgs.
"Japanese Application Serial No. 2020-114434, Response filed Dec. 16, 2021 to Notification of Reasons for Refusal mailed Aug. 24, 2021", w English claims, 7 pgs.
"U.S. Appl. No. 16/715,212, Response filed Dec. 21, 2021 to Non Final Office Action mailed Sep. 21, 2021", 8 pgs.
"Japanese Application Serial No. 2020-114434, Examiners Decision of Final Refusal mailed Mar. 8, 2022", w English translation, 10 pgs.
"U.S. Appl. No. 16/715,212, Notice of Allowance mailed Mar. 16, 2022", 9 pgs.
"U.S. Appl. No. 16/715,212, Supplemental Notice of Allowability mailed Mar. 25, 2022", 2 pgs.
"Japanese Application Serial No. 2022-109867, Voluntary Amendment filed Aug. 3, 2022", w English claims, 8 pgs.
"Japanese Application Serial No. 2020-114434, Response filed Jul. 7, 2022 to Examiners Decision of Final Refusal mailed Mar. 8, 2022", w English claims, 8 pgs.
"European Application Serial No. 22189649.1, Response filed Jun. 2, 2023 to Extended European Search Report mailed Oct. 17, 2022", 29 pgs.
"Japanese Application Serial No. 2022-109867, Notification of Reasons for Refusal mailed Jul. 11, 2023", w English translation, 5 pgs.
"Chinese Application Serial No. 202111355746.0, Office Action mailed Feb. 27, 2024", With English Translation, 13 pgs.
"Japanese Application Serial No. 2022-109867, Response filed Oct. 6, 2023 to Notification of Reasons for Refusal mailed Jul. 11, 2023", w/ English translation, 5 pgs.
"Japanese Application Serial No. 2023-214652, Voluntary Amendment Filed Jan. 16, 2024", w/ English Claims, 12 pgs.
"Chinese Application Serial No. 202111355746.0, Response filed Jun. 27, 2024 to Office Action mailed Feb. 27, 2024", w/ current English claims, 22 pgs.

* cited by examiner

LACING ARCHITECTURE FOR AUTOMATED FOOTWEAR PLATFORM

CLAIM OF PRIORITY

This application is a division of U.S. patent application Ser. No. 16/715,212, filed Dec. 16, 2019, which application is a continuation of U.S. patent application Ser. No. 15/458,816, filed Mar. 14, 2017, now U.S. Pat. No. 10,537,155, issued on Jan. 21, 2020, which application claims the benefit of priority of U.S. Provisional Patent Application Ser. No. 62/413,142, filed on Oct. 26, 2016, and of U.S. Provisional Patent Application Ser. No. 62/424,294, filed on Nov. 18, 2016, the contents of which are incorporated by reference in their entireties.

BACKGROUND

The following specification describes various aspects of a footwear assembly involving a lacing system including a motorized or non-motorized lacing engine, footwear components related to the lacing engines, automated lacing footwear platforms, and related manufacturing processes. More specifically, much of the following specification describes various aspects of lacing architectures (configurations) for use in footwear including motorized or non-motorized lacing engines for centralized lace tightening.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

Figure 1:
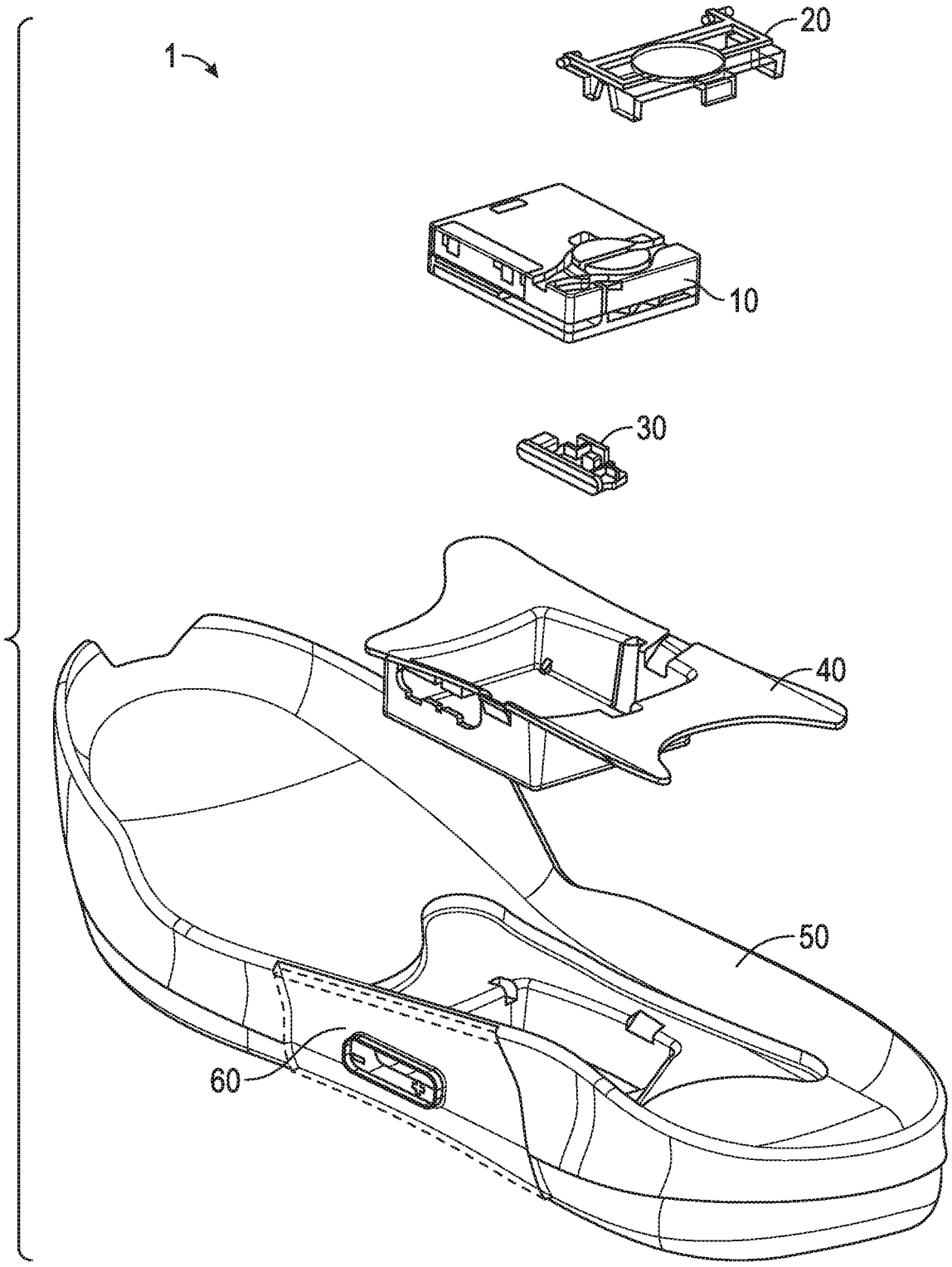
FIG. 1 is an exploded view illustration of components of a portion of a footwear assembly with a motorized lacing system, according to some example embodiments.

Any headings provided herein are merely for convenience and do not necessarily affect the scope or meaning of the terms used or discussion under the heading.

DETAILED DESCRIPTION

The concept of self-tightening shoe laces was first widely popularized by the fictitious power-laced Nike® sneakers worn by Marty McFly in the movie Back to the Future II, which was released back in 1989. While Nike® has since released at least one version of power-laced sneakers similar in appearance to the movie prop version from Back to the Future II, the internal mechanical systems and surrounding footwear platform employed do not necessarily lend themselves to mass production or daily use. Additionally, other previous designs for motorized lacing systems comparatively suffered from problems such as high cost of manufacture, complexity, assembly challenges, and poor serviceability. The present inventors have developed a modular footwear platform to accommodate motorized and non-motorized lacing engines that solves some or all of the problems discussed above, among others. In order to fully leverage the modular lacing engine discussed briefly below and in greater detail in Application Ser. No. 62/308,686, titled "LACING APPARATUS FOR AUTOMATED FOOTWEAR PLATFORM," the present inventors developed a lacing architectures discussed herein. The lacing architectures discussed herein can solve various problems experienced with centralized lace tightening mechanisms, such as uneven tightening, fit, comfort, and performance. The lacing architectures provide various benefits, including smoothing out lace tension across a greater lace travel distance and enhanced comfort while maintaining fit performance. One aspect of enhanced comfort involves a lacing architecture that reduces pressure across the top of the foot. Example lacing architectures can also enhance fit and performance by manipulating lace tension both a medial-lateral direction as well as in an anterior-posterior (front to back) direction. Various other benefits of the components described below will be evident to persons of skill in the relevant arts.

The lacing architectures discussed were developed specifically to interface with a modular lacing engine positioned within a mid-sole portion of a footwear assembly. However, the concepts could also be applied to motorized and manual lacing mechanisms disposed in various locations around the footwear, such as in the heel or even the toe portion of the footwear platform. The lacing architectures discussed include use of lace guides that can be formed from tubular plastic, metal clip, fabric loops or channels, plastic clips, and open u-shaped channels, among other shapes and materials. In some examples, various different types of lacing guides can be mixed to perform specific lace routing functions within the lacing architecture.

The motorized lacing engine discussed below was developed from the ground up to provide a robust, serviceable, and inter-changeable component of an automated lacing footwear platform. The lacing engine includes unique design elements that enable retail-level final assembly into a modular footwear platform. The lacing engine design allows for the majority of the footwear assembly process to leverage known assembly technologies, with unique adaptions to standard assembly processes still being able to leverage current assembly resources.

In an example, the modular automated lacing footwear platform includes a mid-sole plate secured to the mid-sole for receiving a lacing engine. The design of the mid-sole plate allows a lacing engine to be dropped into the footwear platform as late as at a point of purchase. The mid-sole plate, and other aspects of the modular automated footwear platform, allow for different types of lacing engines to be used interchangeably. For example, the motorized lacing engine discussed below could be changed out for a human-powered lacing engine. Alternatively, a fully automatic motorized lacing engine with foot presence sensing or other optional features could be accommodated within the standard mid-sole plate.

Utilizing motorized or non-motorized centralized lacing engines to tighten athletic footwear presents some challenges in providing sufficient performance without sacrificing some amount of comfort. Lacing architectures discussed herein have been designed specifically for use with centralized lacing engines, and are designed to enable various footwear designs from casual to high-performance.

This initial overview is intended to introduce the subject matter of the present patent application. It is not intended to provide an exclusive or exhaustive explanation of the various inventions disclosed in the following more detailed description.

Automated Footwear Platform

The following discusses various components of the automated footwear platform including a motorized lacing engine, a mid-sole plate, and various other components of the platform. While much of this disclosure focuses on lacing architectures for use with a motorized lacing engine, the discussed designs are applicable to a human-powered lacing engine or other motorized lacing engines with additional or fewer capabilities. Accordingly, the term "automated" as used in "automated footwear platform" is not intended to only cover a system that operates without user input. Rather, the term "automated footwear platform" includes various electrically powered and human-power, automatically activated and human activated mechanisms for tightening a lacing or retention system of the footwear.

FIG. 1 is an exploded view illustration of components of a motorized lacing system for footwear, according to some example embodiments. The motorized lacing system 1 illustrated in FIG. 1 includes a lacing engine 10, a lid 20, an actuator 30, a mid-sole plate 40, a mid-sole 50, and an outsole 60. FIG. 1 illustrates the basic assembly sequence of components of an automated lacing footwear platform. The motorized lacing system 1 starts with the mid-sole plate 40 being secured within the mid-sole. Next, the actuator 30 is inserted into an opening in the lateral side of the mid-sole plate opposite to interface buttons that can be embedded in the outsole 60. Next, the lacing engine 10 is dropped into the mid-sole plate 40. In an example, the lacing system 1 is inserted under a continuous loop of lacing cable and the lacing cable is aligned with a spool in the lacing engine 10 (discussed below). Finally, the lid 20 is inserted into grooves in the mid-sole plate 40, secured into a closed position, and latched into a recess in the mid-sole plate 40. The lid 20 can capture the lacing engine 10 and can assist in maintaining alignment of a lacing cable during operation.

In an example, the footwear article or the motorized lacing system 1 includes or is configured to interface with one or more sensors that can monitor or determine a foot presence characteristic. Based on information from one or more foot presence sensors, the footwear including the motorized lacing system 1 can be configured to perform various functions. For example, a foot presence sensor can be configured to provide binary information about whether a foot is present or not present in the footwear. If a binary signal from the foot presence sensor indicates that a foot is present, then the motorized lacing system 1 can be activated, such as to automatically tighten or relax (i.e., loosen) a footwear lacing cable. In an example, the footwear article includes a processor circuit that can receive or interpret signals from a foot presence sensor. The processor circuit can optionally be embedded in or with the lacing engine 10, such as in a sole of the footwear article.

Lacing Architectures

Figure 2:
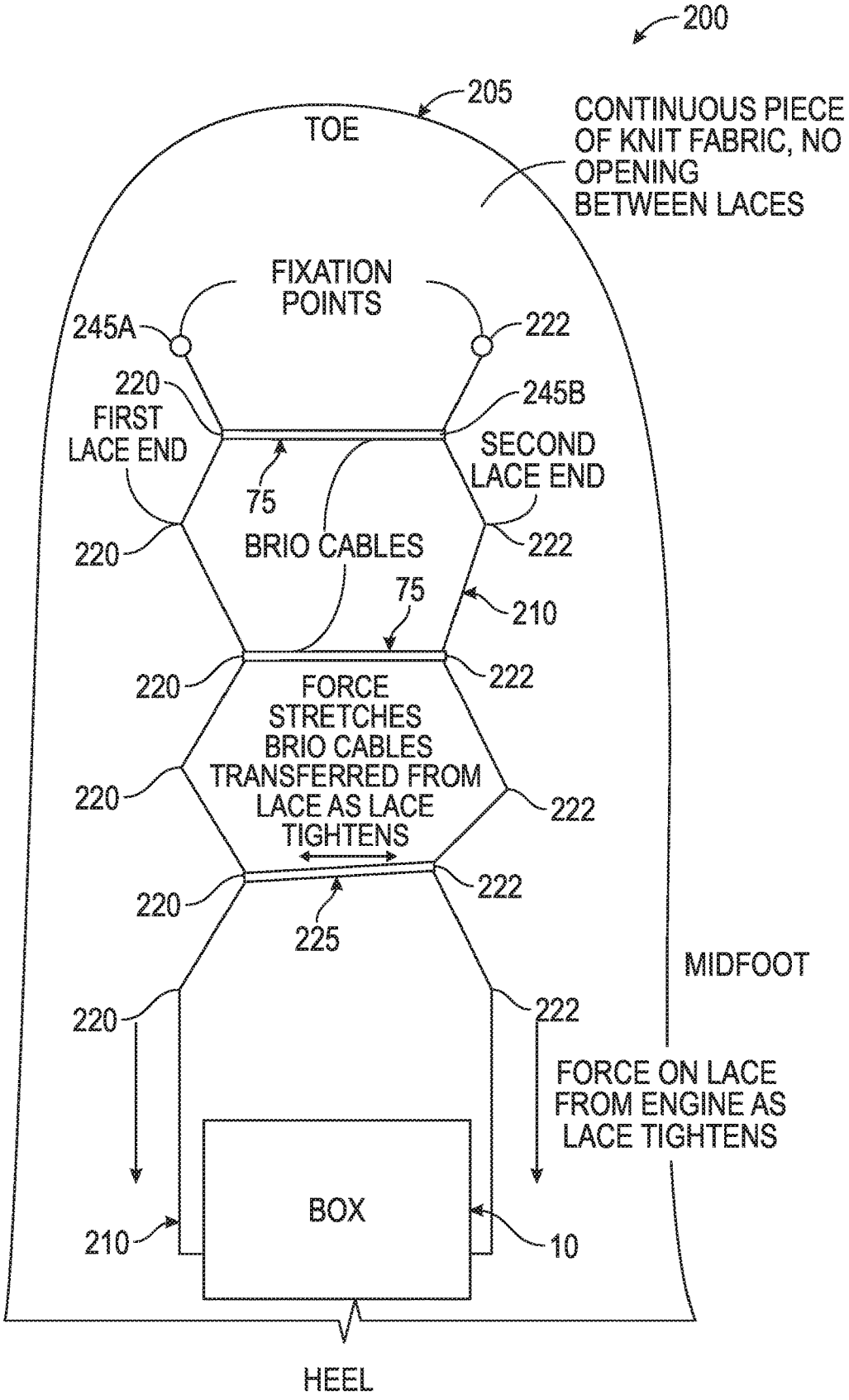
FIG. 2 is a top-view diagram illustrating a lacing architecture for use with footwear assemblies including a motorized lacing engine, according to some example embodiments.

FIG. 2 is a top view diagram of upper 200 illustrating an example lacing configuration, according to some example embodiments. In this example, the upper 205 includes lateral lace fixation 215, medial lace fixation 216, lateral lace guides 222, medial lace guides 220, and brio cables 225, in additional to lace 210 and lacing engine 10. The example illustrated in FIG. 2 includes a continuous knit fabric upper 205 with diagonal lacing pattern involving non-overlapping medial and lateral lacing paths. The lacing paths are created starting at the lateral lace fixation 215 running through the lateral lace guides 222 through the lacing engine 10 up through the medial lace guides 220 back to the medial lace fixation 216. In this example, lace 210 forms a continuous loop from lateral lace fixation 215 to medial lace fixation 216. Medial to lateral tightening is transmitted through brio cables 225 in this example. In other examples, the lacing path may crisscross or incorporate additional features to transmit tightening forces in a medial-lateral direction across the upper 205. Additionally, the continuous lace loop concept can be incorporated into a more traditional upper with a central (medial) gap and lace 210 crisscrossing back and forth across the central gap.

Figure 3A:
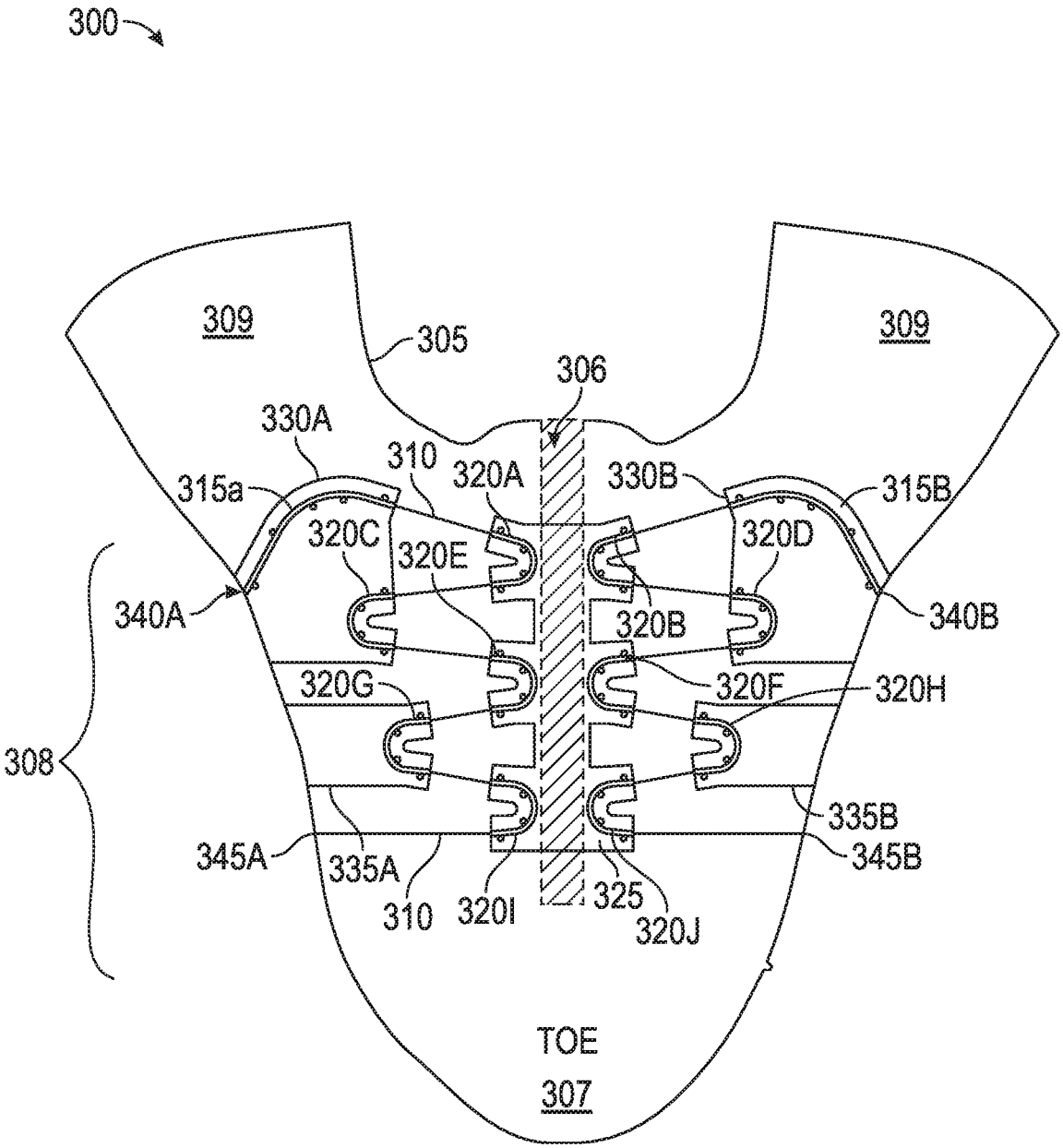
FIGS. 3A-3C are top-view diagrams illustrating a flattened footwear upper with a lacing architecture for use in footwear assemblies including a motorized lacing engine, according to some example embodiments.
Figure 3B:
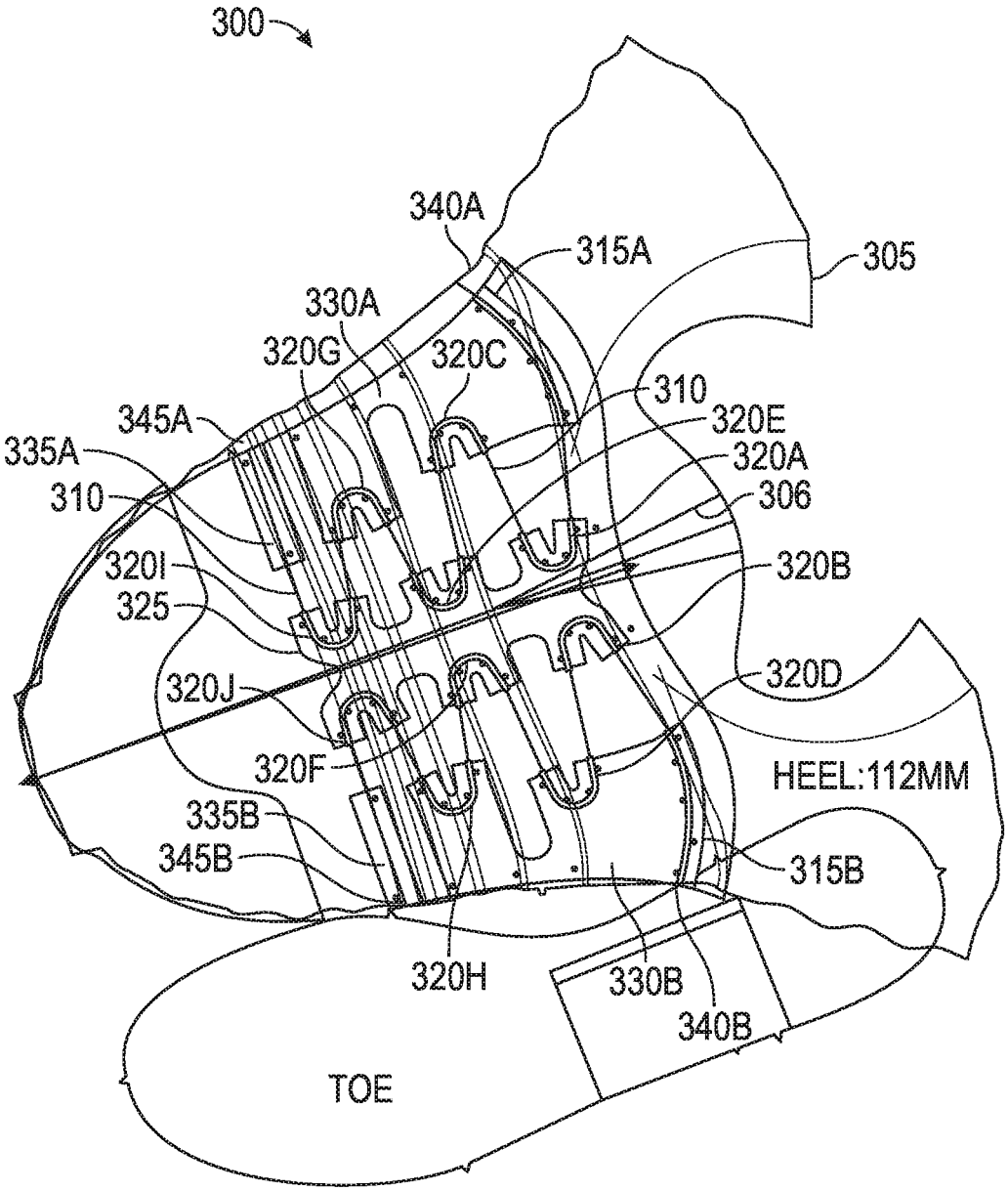
Figure 3C:
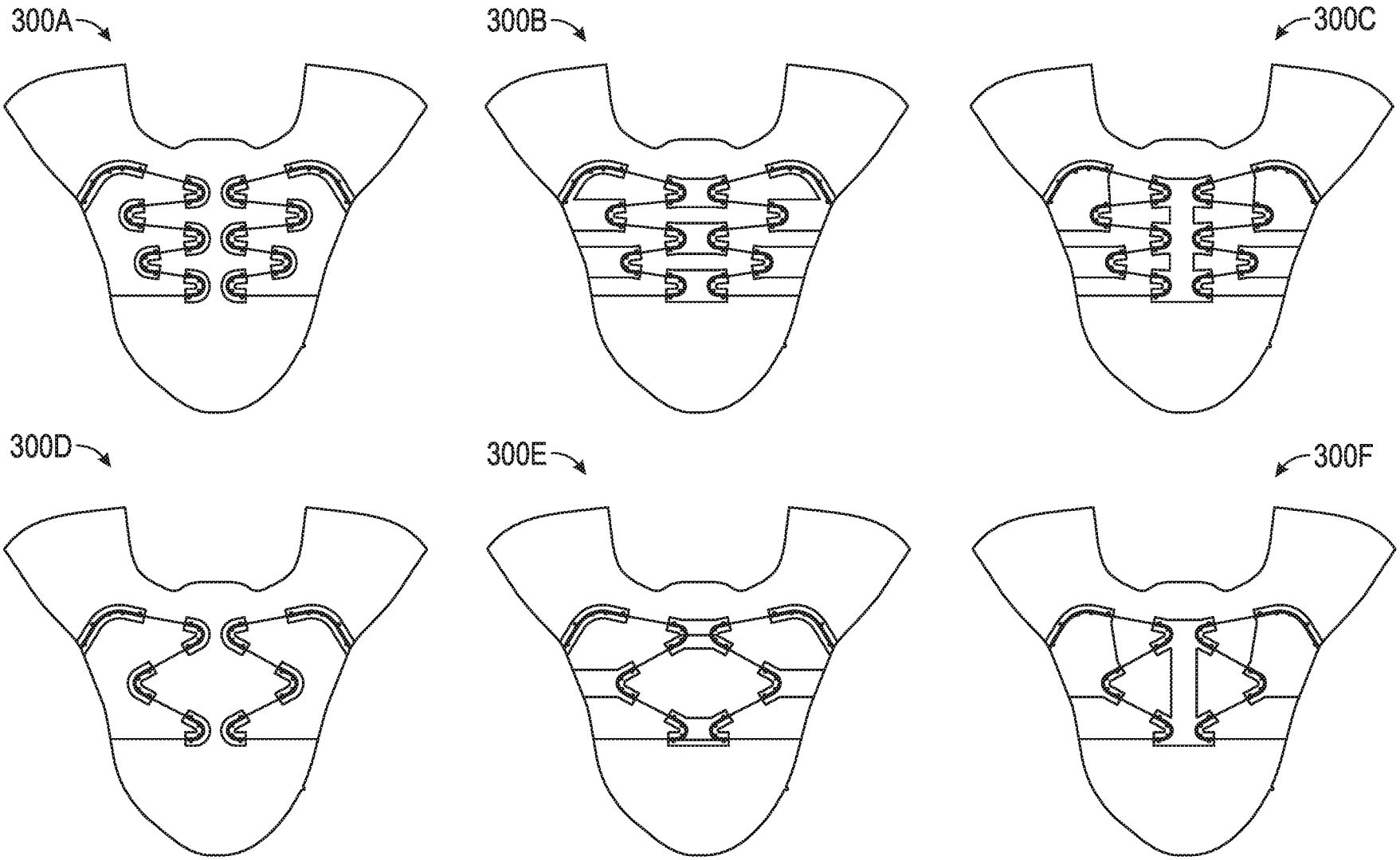

FIGS. 3A-3C are top-view diagrams illustrating a flattened footwear upper 305 with a lacing architecture 300 for use in footwear assemblies including a motorized lacing engine, according to some example embodiments. For the purposes of discussing example footwear uppers, the upper 305 is assumed to be designed for incorporation into a right foot version of a footwear assembly. FIG. 3A is a top-view diagram of a flattened footwear upper 305 with a lacing architecture 300 as illustrated. In this example, footwear upper 305 includes a series of lace guides 320A-320J (collectively referred to as lace guide(s) 320) with a lace cable 310 running through the lace guides 320. The lace cable 310, in this example, forms a loop that is terminated on each side of the upper 305 at a lateral lace fixation 345A and a medial lace fixation 345B (collectively referred to as lace fixation points 345) with the middle portion of the loop routed through a lacing engine within a mid-sole of the footwear assembly. The upper 305 also includes reinforcements associated with each of the series of lace guides 320. The reinforcements can cover individual lace guides or span multiple lace guides. In this example, the reinforcements include a central reinforcement 325, a first lateral reinforcement 335A, a first medial reinforcement 335B, a second lateral reinforcement 330A, a second medial reinforcement 330B. The middle portion of the lace cable 310 is routed to and/or from the lacing engine via a lateral rear lace guide 315A and a medial rear lace guide 315B, and exits and/or enters the upper 300 through a lateral lace exit 340A and a medial lace exit 340B.

The upper 305 can include different portions, such as a forefoot (toe) portion 307, a mid-foot portion 308, and a heel portion 309. The forefoot portion 307 corresponding with joints connecting metatarsal bones with phalanx bones of a foot. The mid-foot point 308 may correspond with an arch area of the foot. The heel portion 309 may correspond with the rear or heel portions of the foot. The medial and lateral sides of the mid-foot portion of the upper 305 can include a central portion 306. In some common footwear designs the central portion 306 can include an opening spanned by crisscrossing (or similar) pattern of laces that allows for the fit of the footwear upper around the foot to be adjusted. A central portion 306 including an opening also facilitates entry and removal of the foot from the footwear assembly.

The lace guides 320 are tubular or channel structures to retain the lace cable 310, while routing the lace cable 310 through a pattern along each of a lateral side and a medial side of the upper 305. In this example, the lace guides 320 are u-shaped plastic tubes laid out in an essentially sinusoidal wave pattern, which cycles up and down along the medial and lateral sides of the upper 305. The number of cycles completed by the lace cable 310 may vary depending on shoe size. Smaller sized footwear assemblies may only be able to accommodate one and one half cycles, with the example upper 305 accommodating two and one half cycles before entering the medial rear lace guide 315B or the lateral rear lace guide 315A. The pattern is described as essentially sinusoidal, as in this example at least, the u-shape guides have a wider profile than a true sine wave crest or trough. In other examples, a pattern more closely approximating a true sine wave pattern could be utilized (without extensive use of carefully curved lace guides, a true sine wave is not easily attained with a lace stretched between lace guides). The shape of the lace guides 320 can be varied to generate different torque versus lace displacement curves, where torque is measured at the lacing engine in the mid-sole of the shoe. Using lace guides with tighter radius curves, or including a higher frequency of wave pattern (e.g., greater number of cycles with more lace guides), can result in a change to the torque versus lace displacement curve. For example, with tighter radius lace guides the lace cable experiences higher friction, which can result in a higher initial torque, which may appear to smooth out the torque out over the torque versus lace displacement curve. However, in certain implementations it may be more desirable to maintain a low initial torque level (e.g., by keep friction within the lace guides low) while utilizing lace guide placement pattern or lace guide design to assist in smoothing the torque versus lace displacement curve. One such lace guide design is discussed in reference to FIGS. 7A and 7B, with another alternative lace guide design discussed in reference to FIGS. 8A through 8G. In addition to the lace guides discussed in reference to these figures, lace guides can be fabricated from plastics, polymers, metal, or fabric. For example, layers of fabric can be used to create a shaped channel to route a lace cable in a desired pattern. As discussed below, combinations of plastic or metal guides and fabric overlays can be used to generate guide components for use in the discussed lacing architectures.

Returning to FIG. 3A, the reinforcements 325, 335, and 330 are illustrated associated with different lace guides, such as lace guides 320. In an example, the reinforcements 335 can include fabric impregnated with a heat activated adhesive that can be adhered over the top of lace guides 320G, 320H, a process sometimes referred to as hot melt. The reinforcements can cover a number of lace guides, such as reinforcement 325, which in this example covers six upper lace guides positioned adjacent to a central portion of the footwear, such as central portion 306. In another example, the reinforcement 325 could be split down the middle of the central portion 306 to form two pieces covering lace guides along a medial side of the central portion 306 separately from lace guides along a lateral side of the central portion 306. In yet another alternative example, the reinforcement 325 could be split into six separate reinforcements covering individual lace guides. Use of reinforcements can vary to change the dynamics of interaction between the lace guides and the underlying footwear upper, such as upper 305. Reinforcements can also be adhered to the upper 305 in various other manners, including sewing, adhesives, or a combination of mechanisms. The manner of adhering the reinforcement in conjunction with the type of fabric or materials used for the reinforcements can also impact the friction experienced by the lace cable running through the lace guides. For example, a more rigid material hot melted over otherwise flexible lace guides can increase the friction experienced by the lace cable. In contrast, a flexible material adhered over the lace guides may reduce friction by maintaining more of the lace guide flexibility.

As mentioned above, FIG. 3A illustrates a central reinforcement 325 that is a single member spanning the medial and lateral upper lace guides (320A, 320B, 320E, 320F, 320I, and 320J). Assuming reinforcement 325 is more rigid material with less flexibility than the underlying footwear upper, upper 305 in this example, the resulting central portion 306 of the footwear assembly will exhibit less forgiving fit characteristics. In some applications, a more rigid, less forgiving, central portion 306 may be desirable. However, in applications where more flexibility across the central portion 306 is desired, the central reinforcement 325 can be separated into two or more reinforcements. In certain applications, separated central reinforcements can be coupled across the central portion 306 using a variety of flexible or elastic materials to enable a more form fitting central portion 306. In some examples, the upper 305 can have a small gap running the length of the central portion 306 with one or more elastic members spanning the gap and connecting multiple central reinforcements, such as is at least partially illustrated in FIG. 4 with lace guide 410 and elastic member 440.

FIG. 3B is another top-view diagram of the flattened footwear upper 305 with a lacing architecture 300 as illustrated. In this example, footwear upper 305 includes a similar lace guide pattern including lace guides 320 with modifications to the configuration of reinforcements 325, 330, and 335. As discussed above, the modifications to the reinforcements configuration will result in at least slightly different fit characteristics and may also change the torque versus lace displacement curve.

FIG. 3C is a series of lacing architecture examples illustrated on flattened footwear uppers according to example embodiments. Lace architecture 300A illustrates a lace guide pattern similar to the sine wave pattern discussed in reference to FIG. 3A with individual reinforcements covering each individual lace guide. Lace architecture 300B once again illustrates a wave lacing pattern, also referred to as parachute lacing, with elongated reinforcements covering upper lace guide pairs spanning across a central portion and individual lower lace guides. Lace architecture 300C is yet another wave lacing pattern with a single central reinforcement. Lace architecture 300D introduces a triangular shaped lace pattern with individual reinforcements cut to form fit over the individual lace guides. Lace architecture 300E illustrates a variation in reinforcement configuration in the triangular lace pattern. Finally, lace architecture 300F illustrates another variation in reinforcement configuration including a central reinforcement and consolidated lower reinforcements.

Figure 4:
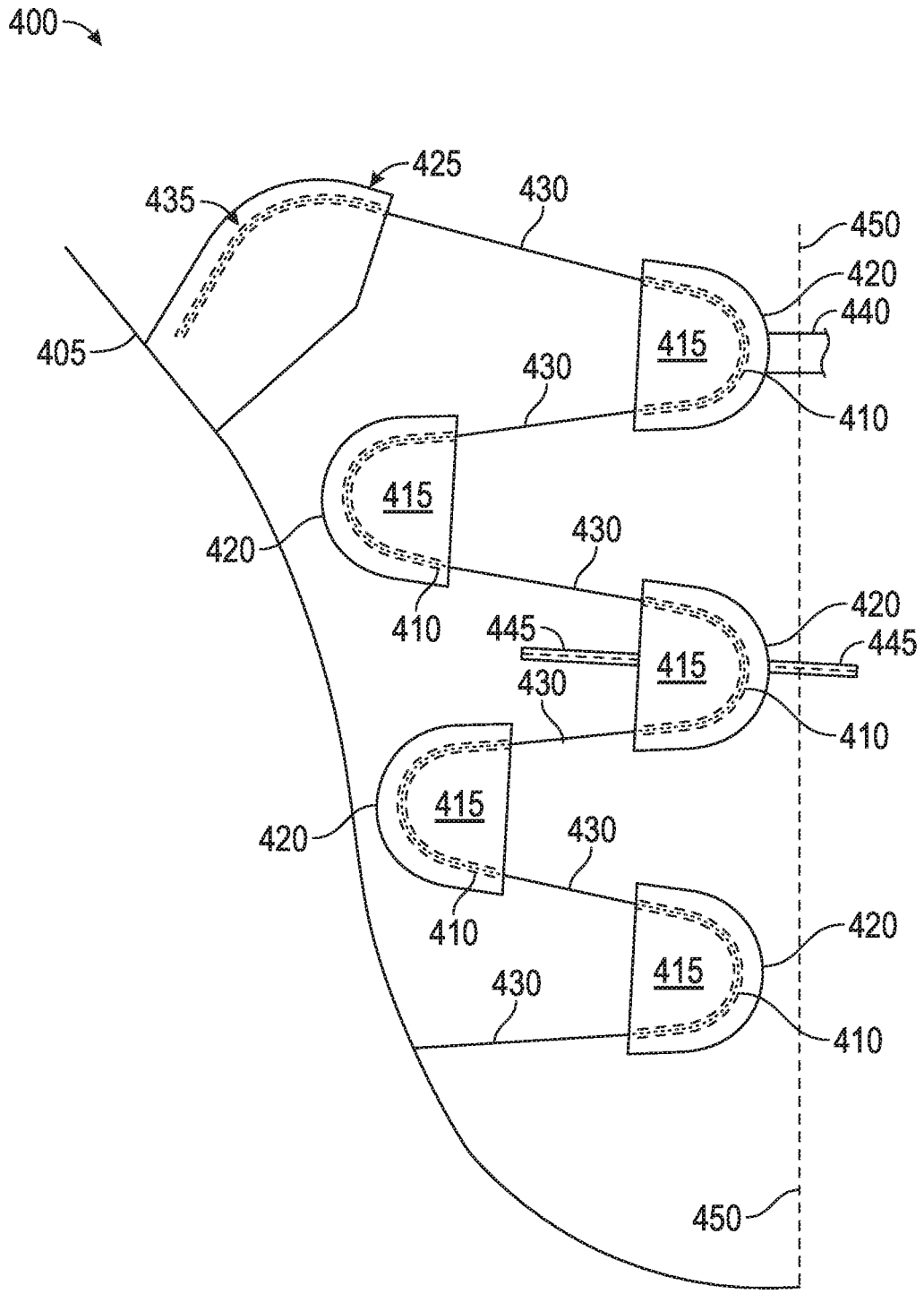
FIG. 4 is a diagram illustrating a portion of a footwear upper with a lacing architecture for use in footwear assemblies including a motorized lacing engine, according to some example embodiments.

FIG. 4 is a diagram illustrating a portion of a footwear upper 405 with a lacing architecture 400 for use in footwear assemblies including a motorized lacing engine, according to some example embodiments. In this example, a medial portion of upper 405 is illustrated with lace guides 410 routing lace cable 430 through to medial exit guide 435. Lace guides 410 are encapsulated in reinforcements 420 to form lace guide components 415, with at least a portion of the lace guide components being repositionable on upper 405. In one example, the lace guide components 415 are backed with hook-n-loop material and the upper 405 provides a surface receptive to the hook-n-loop material. In this example, the lace guide components 415 can be backed with the hook portion with the upper 405 providing a knit loop surface to receive the lace guide components 415. In another example, lace guide components 415 can have a track interface integrated to engage with a track, such as track 445. A track-based integration can provide a secure, limited travel, movement option for lace guide components 415. For example, track 445 runs essentially perpendicular to the longitudinal axis of the central portion 450 and allows for positioning a lace guide component 415 along the length of the track. In some examples, the track 445 can span across from a lateral side to a medial side to hold a lace guide component on either side of central portion 450. Similar tracks can be positioned in appropriate places to hold all of the lace guide components 415, enabling adjustment in restrictions directions for all lace guides on footwear upper 405.

The footwear upper 405 illustrates another example lacing architecture including central elastic members, such as elastic member 440. In these examples, at least the upper lace guide components along the medial and lateral sides can be connected across the central portion 450 with elastic members that allow for different footwear designs to attain different levels of fit and performance. For example, a high performance basketball shoe that needs to secure a foot through a wide range of lateral movement may utilize elastic members with a high modulus of elasticity to ensure a snug fit. In another example, a running shoe may utilize elastic members with a low modulus of elasticity, as the running shoe may be designed to focus on comfort for long distance road running versus providing high levels of lateral motion containment. In certain examples, the elastic members 440 can be interchangeable or include a mechanism to allow for adjustment of the level of elasticity. As discussed above, in some examples the footwear upper, such as upper 405, can include a gap along central portion 450 at least partially separating a medial side from a lateral side. Even with a small gap along central portion 450 elastic members, such as elastic member 440, can be used to span the gap.

While FIG. 4 only illustrates a single track 445 or a single elastic member 440, these elements can be replicated for any or all of the lace guides in a particular lacing architecture.

Figure 5:
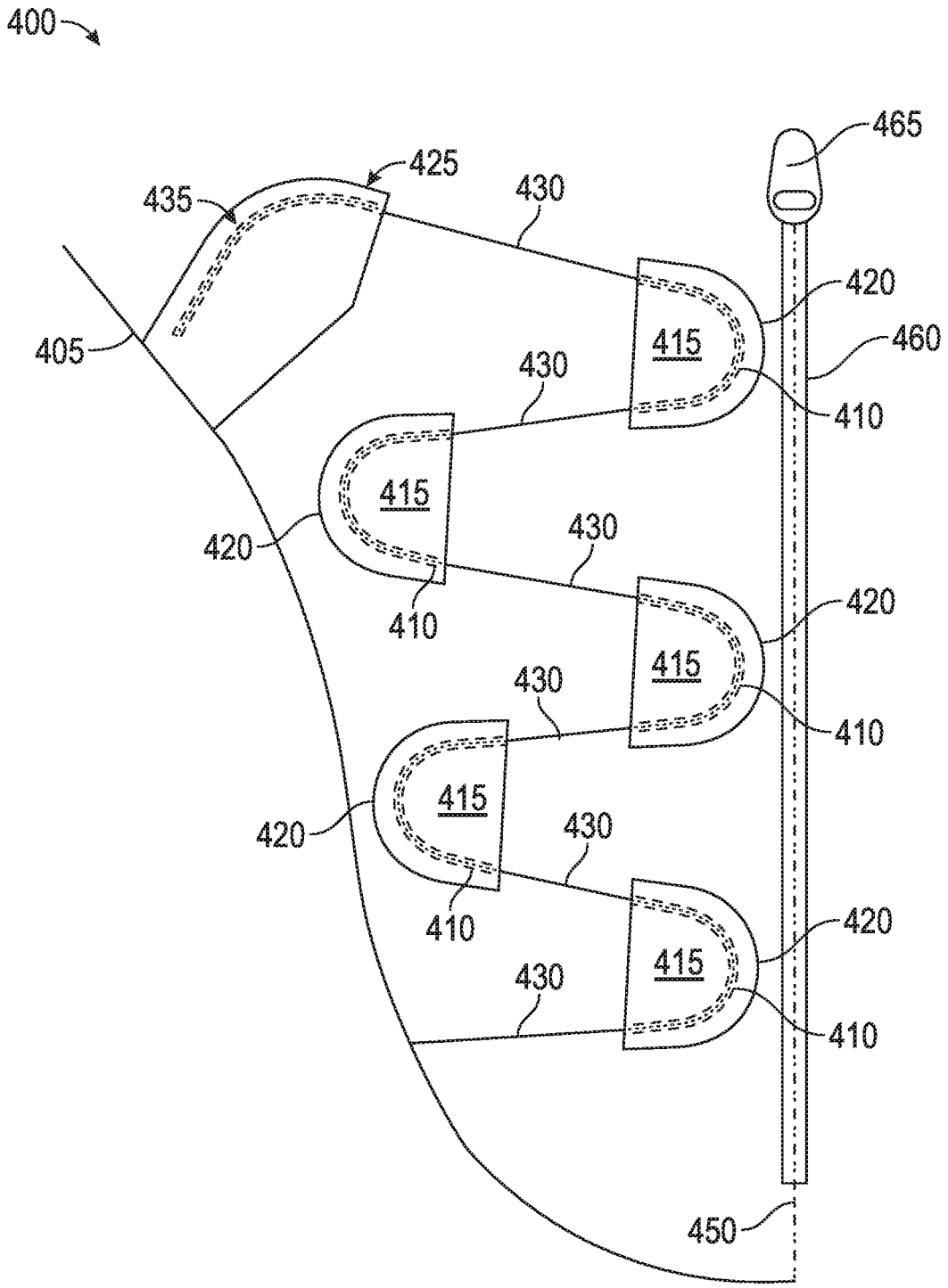
FIG. 5 is a diagram illustrating a portion of a footwear upper with a lacing architecture for use in footwear assemblies including a motorized lacing engine, according to some example embodiments.

FIG. 5 is a diagram illustrating a portion of footwear upper 405 with lacing architecture 400 for use in footwear assemblies including a motorized lacing engine, according to some example embodiments. In this example, the central portion 450 illustrated in FIG. 4 is replaced with a central closure mechanism 460, which is illustrated in this example as a central zipper 465. The central closure mechanism is designed to enable a wider opening in the footwear upper 405 for easy entry and exit. The central zipper 465 can be easily unzipped to enable foot entry or exit. In other examples, the central closure 460 can be hook and loop, snaps, clasps, toggles, secondary laces, or any similar closure mechanism.

Figure 6:
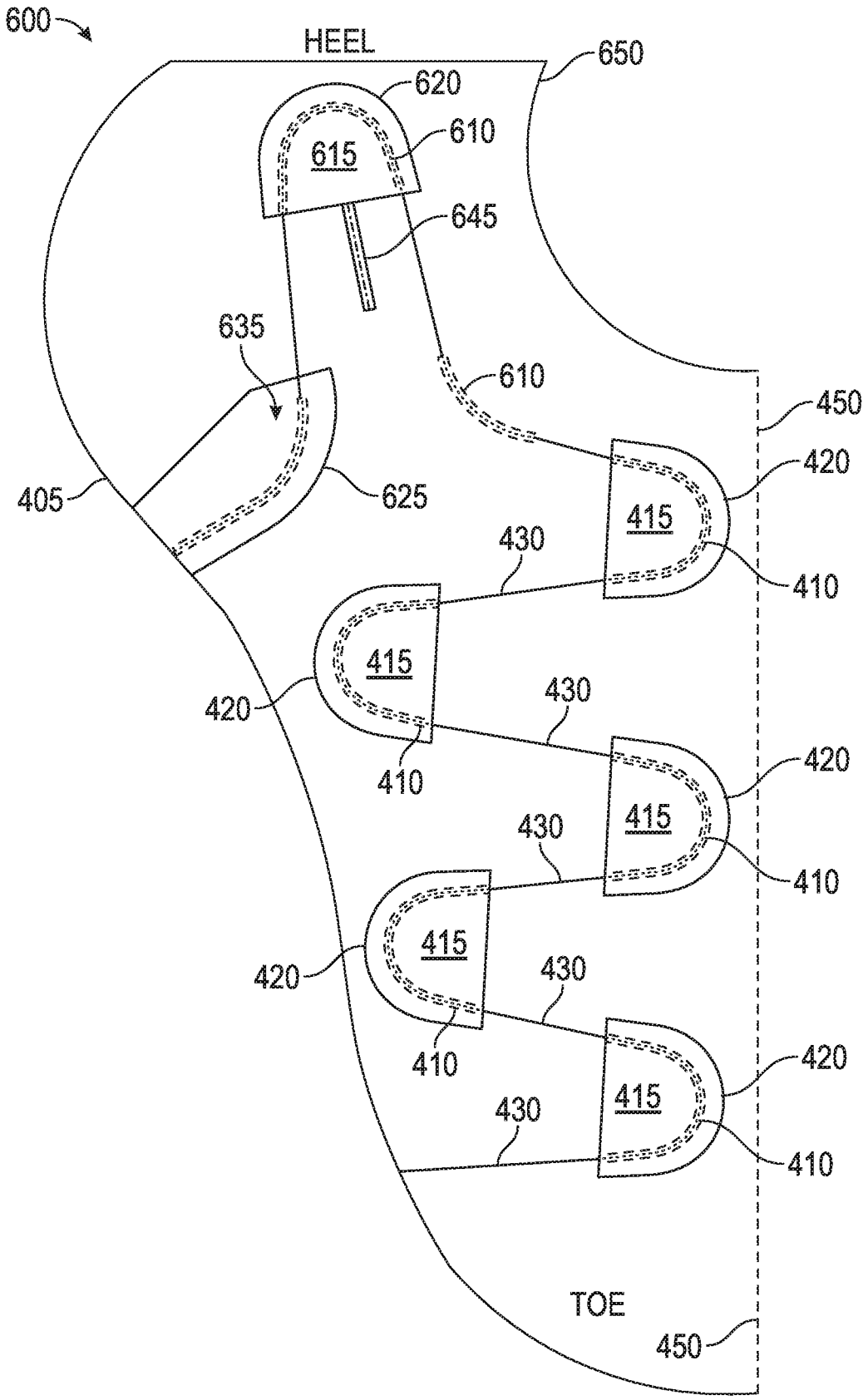
FIG. 6 is a diagram illustrating a portion of a footwear upper with a lacing architecture for use in footwear assemblies including a motorized lacing engine, according to some example embodiments.

FIG. 6 is a diagram illustrating a portion of footwear upper 405 with a lacing architecture 600 for use in footwear assemblies including a motorized lacing engine, according to some example embodiments. In this example, lacing architecture 600 adds a heel lacing component 615 including a heel lacing guide 610 and a heel reinforcement 620 as well as a heel redirect guide 610 and a heel exit guide 635. The heel redirect guide 610 shifts the lace cable 430 from exiting the last lace guide 410 towards a heel lacing component 615. The heel lacing component 615 is formed from a heel lacing guide 610 with a heel reinforcement 620. The heel lacing guide 610 is depicted with a similar shape to lacing guides used in other locations on upper 405. However, in other examples the heel lacing guide 610 can be other shapes or include multiple lace guides. In this example, the heel lace component 615 is shown mounted on a heel track 645 allowing for adjustability of the location of the heel lace component 615. Similar to the adjustable lace guides discussed above, other mechanisms can be utilized to enable adjustment in positioning of the heel lace component 615, such as hook and loop fasteners or comparable fastening mechanisms.

In some examples, the upper 405 includes a heel ridge 650, which like the central portion 450 discussed above can include a closure mechanism. In examples with a heel closure mechanism, the heel closure mechanism is designed to provide easy entry and exit from the footwear by expanding a traditional footwear assembly foot opening. Additionally, in some examples, the heel lacing component 615 can be connected across the heel ridge 650 (with or without a heel closure mechanism) to a matching heel lacing component on the opposite side. The connection can include an elastic member, similar to elastic member 440.

Figure 7A:
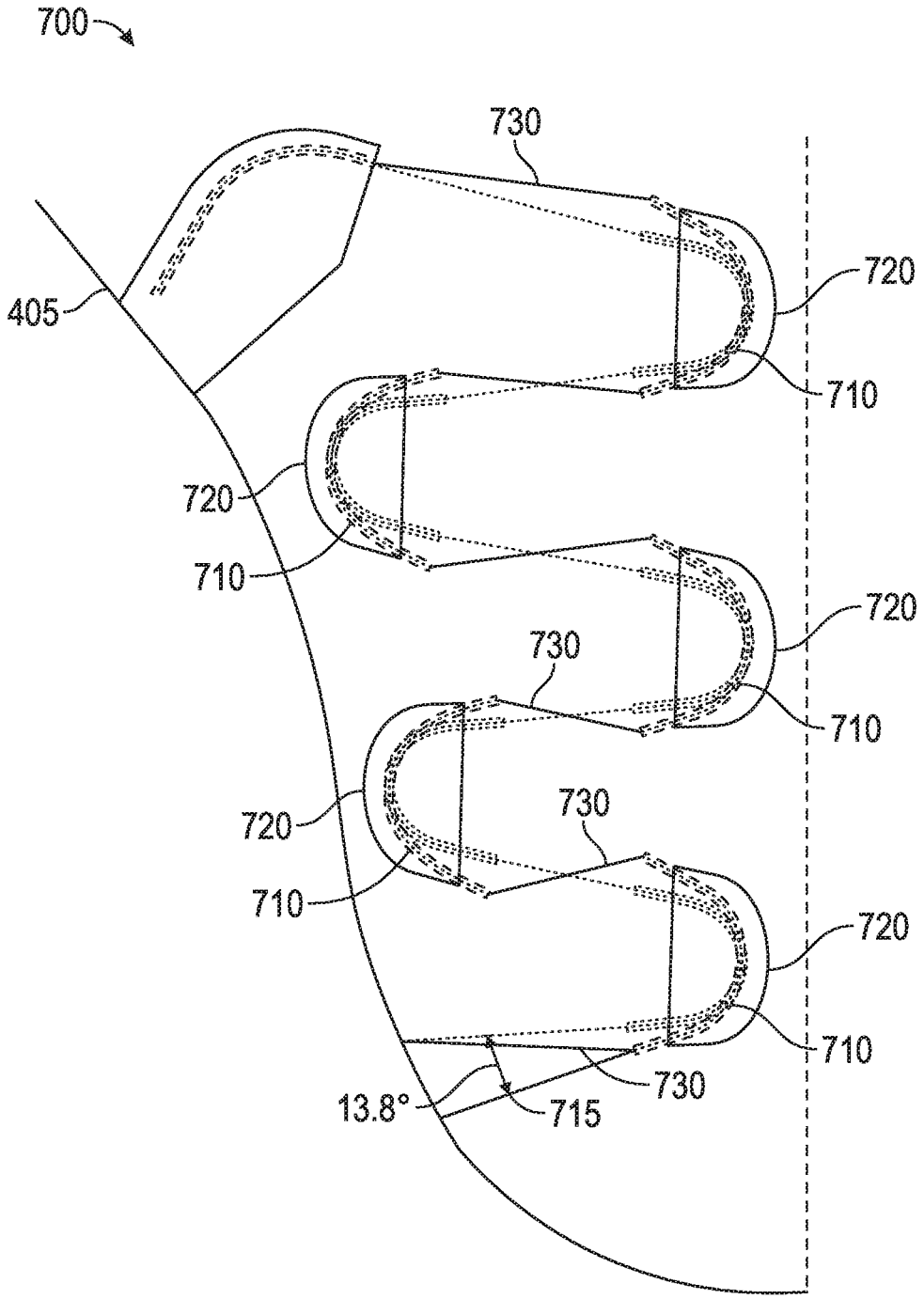
FIGS. 7A-7B are diagrams illustrating a portion of a footwear upper with a lacing architecture for use in footwear assemblies including a motorized lacing engine, according to some example embodiments.
Figure 7B:
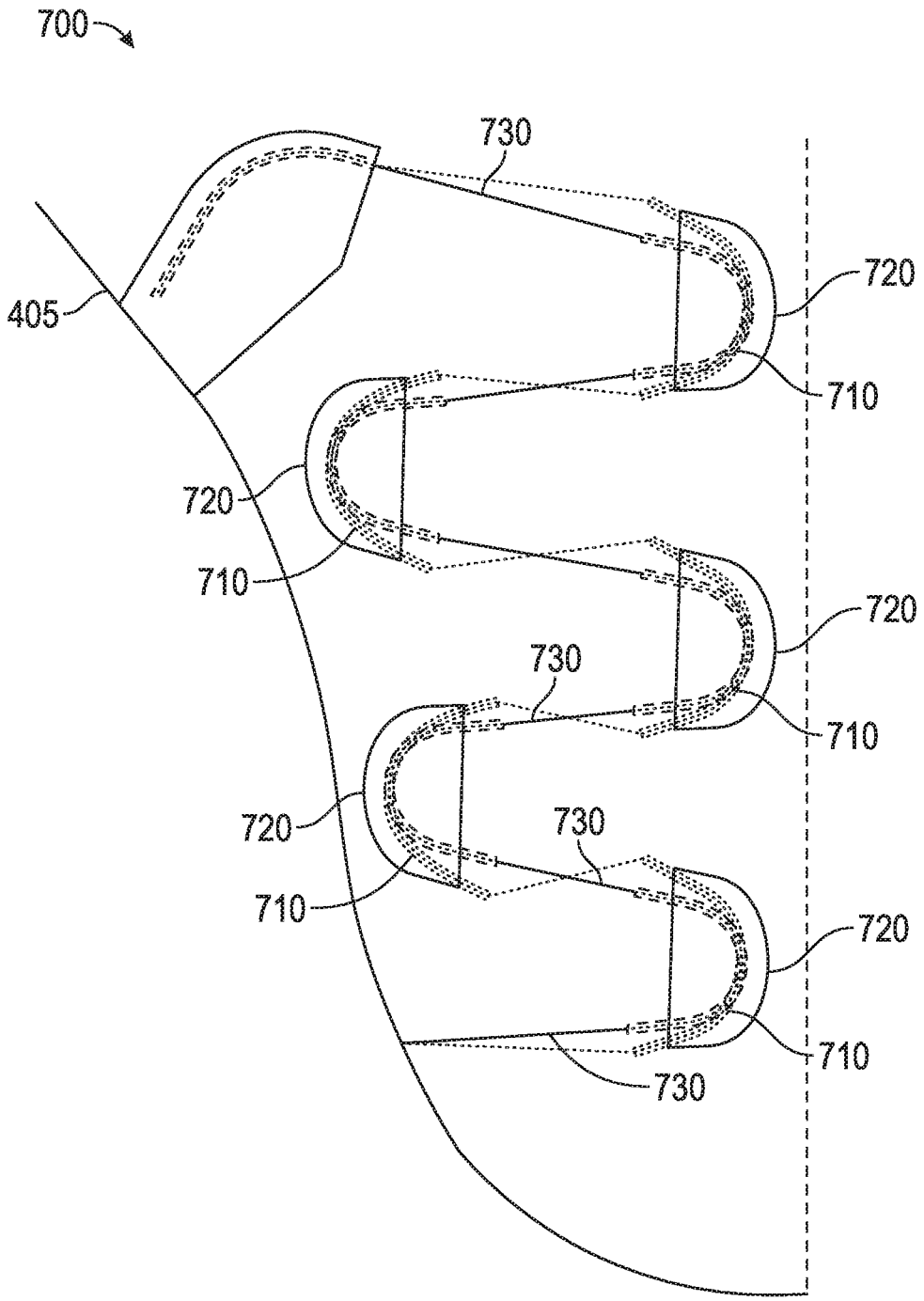

FIG. 7A-7B are diagrams illustrating a portion of footwear upper 405 with a lacing architecture 700 for use in footwear assemblies including a motorized lacing engine, according to some example embodiments. In this example, the lacing architecture 700 includes lace guides 710 for routing lace 730. The lace guides 710 can include associated reinforcements 720. In this example, the lace guides 710 are configured to allow for flexing of portions of the lace guides 710 from an open initial position illustrated in FIG. 7A to a flexed closed position illustrated in FIG. 7B (with phantom lines illustrating the opposition positions in each figure for reference). In this example, the lace guides 710 include extension portions that exhibit flex of approximately 14 degrees between the open initial position and the closed position. Other examples, can exhibit more or less flex between an initial and final position (or shape) of the lace guide 710. The flexing of the lace guides 710 occurs as the lace 730 is tightened. The flexing of the lace guides 710 works to smooth out the torque versus lace displacement curve by applying some initial tension to the lace 730 and providing an additional mechanism to dissipate lace tension during the tightening process. Accordingly, in an initial shape or flex position, lace guide 710 creates some initial tension in the lace cable, which also functions to take up slack in the lace cable. When tightening of the lace cable begins, the lace guide 710 flexes or deforms The lace guides 710, in this example, are plastic or polymer tubes and can have different modulus of elasticity depending upon the particular composition of the tubes. The modulus of elasticity of the lace guides 710 along with the configuration of the reinforcements 720 will control the amount of additional tension induced in the lace 730 by flexing of the lace guides 710. The elastic deformation of the ends (legs or extensions) of the lace guides 710 induces a continued tension on the lace 730 as the lace guides 710 attempt to return to original shape. In some examples, the entire lace guide flexes uniformly over the length of the lace guide. In other examples, the flex occurs primarily within the u-shaped portion of the lace guide with the extensions remaining substantially straight. In yet other examples, the extensions accommodate most of the flex with the u-shaped portion remaining relatively fixed.

The reinforcements 720 are adhered over the lace guides 710 in a manner that allows for movement of the ends of the lace guides 710. In some examples, reinforcements 720 are adhered through the hot melt process discussed above, with the placement of the heat activated adhesive allowing for an opening to enable flex in the lace guides 710. In other embodiments, the reinforcements 720 can be sewed into place or use a combination of adhesives and stitching. How the reinforcements 720 are adhered or structured can affect what portion of the lace guide flexes under load from the lace cable. In some examples, the hot melt is concentrated around the u-shaped portion of the lace guide leaving the extensions (legs) more free to flex.

Figure 7C:
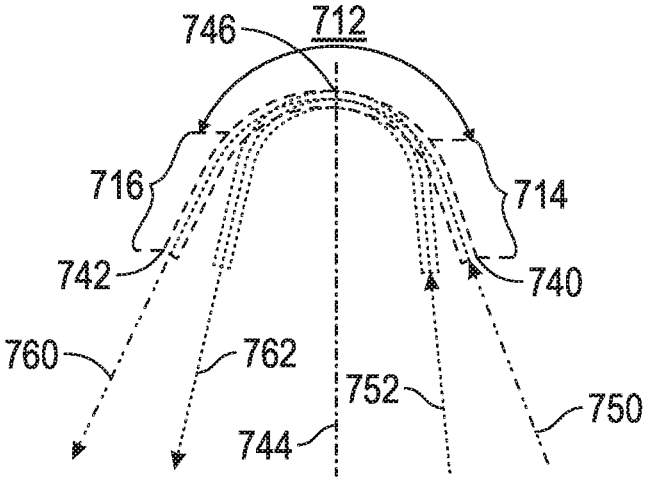
FIGS. 7C-7D are diagrams illustrating deformable lace guides for use in footwear assemblies, according to some example embodiments.
Figure 7D:
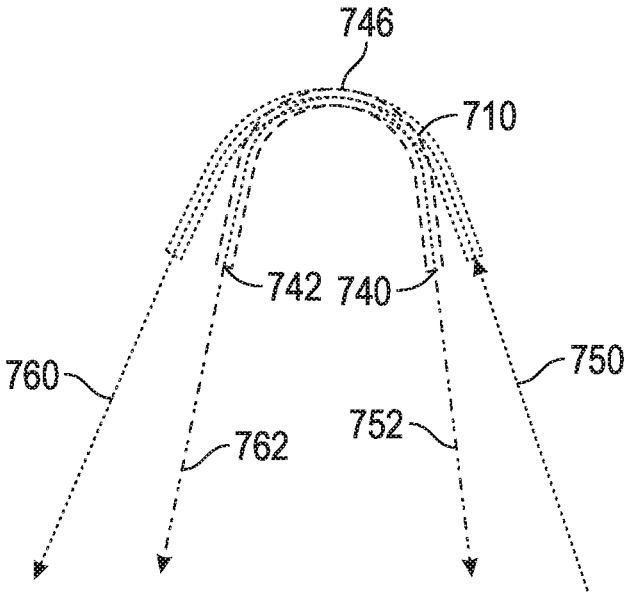

FIGS. 7C-7D are diagrams illustrating deformable lace guides 710 for use in footwear assemblies, according to some example embodiments. In this example, lace guides 710 introduced above in reference to FIGS. 7A and 7B are discussed in additional detail. FIG. 7C illustrates the lace guide 710 in a first (open) state, which can be considered a non-deformed state. FIG. 7D illustrates the lace guide 710 in a second (closed/flexed) state, which can be considered a deformed state. The lace guide 710 can include three different sections, such as a middle section 712, a first extension 714, and a second extension 716. The lace guide 710 can also include a lace reception opening 740 and a lace exit opening 742. As mentioned above, lace guide 710 can have different modulus of elasticity, which controls the level of deformation with a certain applied tension. In some examples, the lace guide 710 can be constructed with different sections having different modulus of elasticity, such as the middle section 712 having a first modulus of elasticity, the first extension having a second modulus of elasticity and the second extension having a third modulus of elasticity. In certain examples, the second and third moduli of elasticity can be substantially similar, resulting in the first extension and the second extension flexing or deforming in a similar manner. In this example, substantially similar can be interpreted as the moduli of elasticity being within a few percentage points of each other. In some examples, the lace guide 710 can have a variable modulus of elasticity shifting from a high modulus at the apex 746 to a low modulus towards the outer ends of the first extension and the second extension. In these examples, the modulus can vary based on wall thickness of the lace guide 710.

The lace guide 710 defines a number of axes useful is describing how the deformable lace guide functions. For example, the first extension 714 can define an first incoming lace axis 750, which aligns with at least an outer portion of an inner channel defined within the first extension 714. The second extension 716 defines an first outgoing lace axis 760, which aligns with at least an outer portion of an inner channel defined within the second extension 716. Upon deformation, the lace guide 710 defines a second incoming lace axis 752 and a second outgoing lace axis 762, which are each aligned with respective portions of the first extension and the second extension. The lace guide 710 also includes a medial axis 744 that intersects the lace guide 710 at the apex 746 and is equidistant from the first extension and the second extension (assuming a symmetrical lace guide in a non-deformed state as illustrated in FIG. 7C).

Figure 7E:
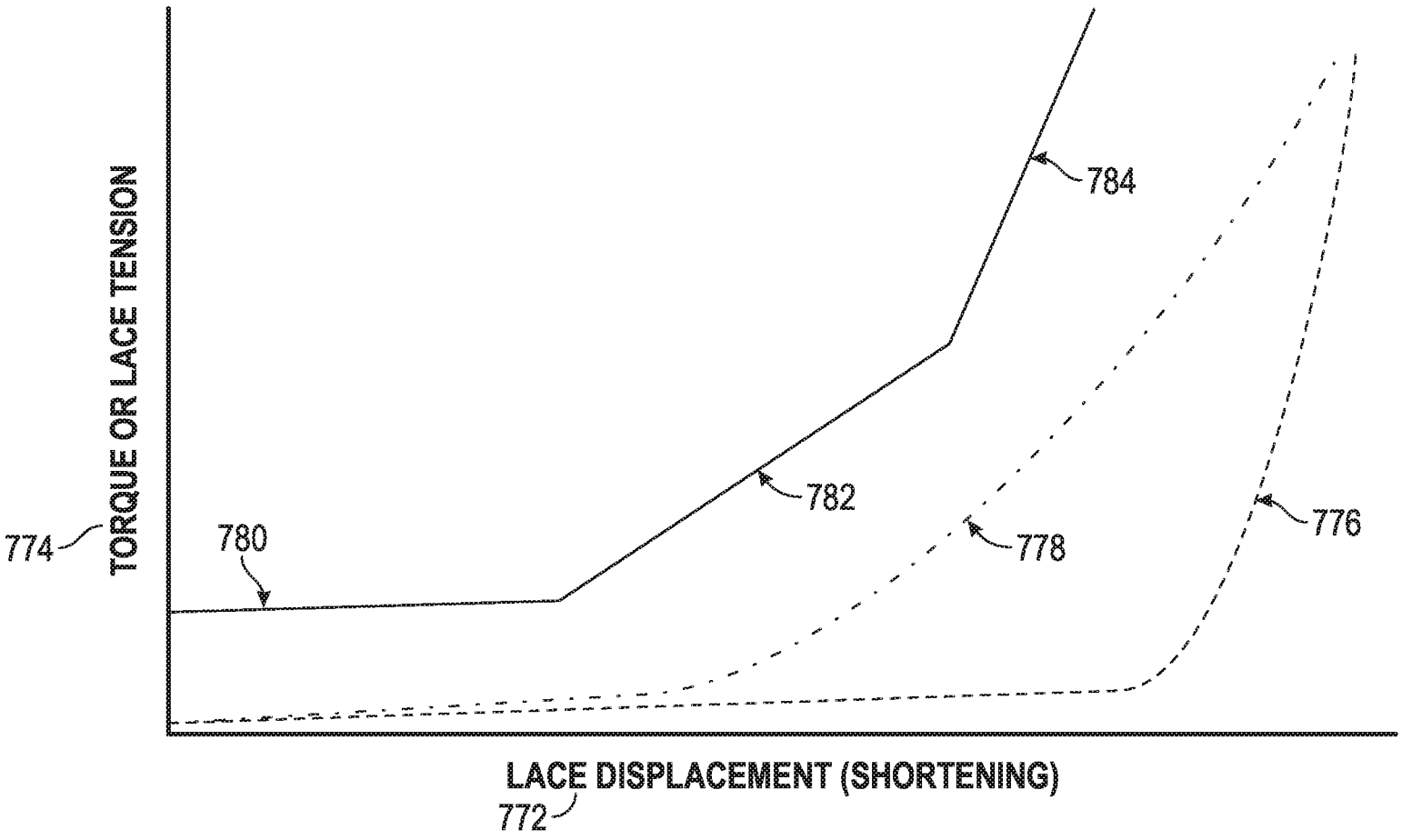
FIG. 7E is a graph illustrating various torque versus lace displacement curves for deformable lace guides, according to some example embodiments.

FIG. 7E is a graph 770 illustrating various torque versus lace displacement curves for deformable lace guides, according to some example embodiments. As discussed above, one of the benefits achieved using lace guides 710 involves modifying torque (or lace tension) versus lace displacement (or shortening) curves. Curve 776 illustrates a torque versus displacement curve for a non-deformable lace guide used in an example lacing architecture. The curve 776 illustrates how laces experience a rapid increase in tension over a short displacement near the end of the tightening process. In contrast, curve 778 illustrates a torque versus displacement curve for a first deformable lace guide used in an example lacing architecture. The cure 778 begins in a fashion similar to curve 776, but as the lace guides deform with additional lace tension the curve is flattened, resulting in tension increasing over a larger lace displacement. Flattening out the curves allows for more control of fit and performance of the footwear for the end users.

The final example is split into three segments, an initial tightening segment 780, an adaptive segment 782, and a reactive segment 784. The segments 780, 782, 784 may be utilized in any circumstance where the torque and resultant displacement is desired. However, the reactive segment 784 may particularly be utilized in circumstances where the motorized lacing engine makes sudden changes or corrections in the displacement of the lace in reaction to unanticipated external factors, e.g., the wearer has abruptly stopped moving, resulting in a relatively high load on the lace. The adaptive segment 782, by contrast, may be utilized when more gradual displacement of the lace may be utilized because a change in the load on the lace may be anticipated, e.g., because the change in load may be less sudden or a change in activity is input into the motorized lacing engine by the wearer or the motorized lacing engine is able to anticipate a change in activity through machine learning. The deformable lace guide design resulting in this final example, is designed to create the adaptive segment 782 and reactive segment 784 through lace guide structural design (such as channel shape, material selection, or a combination parameters). The lacing architecture and lace guides producing the final example, also produce a pre-tension in the lace cable resulting in the illustrated initial tightening segment 780.

FIGS. 8A-8F are diagrams illustrating an example lacing guide 800 for use in certain lacing architectures, according to some example embodiments. In this example, an alternative lace guide with an open lace channel is illustrated. The lacing guide 800 described below can be substituted into any of the lacing architectures discussed above in reference to lace guide 410, heel lace guide 610, or even the medial exit guide 435. All of the various configurations discussed above will not be repeated here for the sake of brevity. The lacing guide 800 includes a guide tab 805, a stitch opening 810, a guide superior surface 815, a lace retainer 820, a lace channel 825, a channel radius 830, a lace access opening 840, a guide inferior surface 845, and a guide radius 850. Advantages of an open channel lace guide, such as lacing guide 800, include the ability to easily route the lace cable after installation of the lace guides on the footwear upper. With tubular lace guides as illustrated in many of the lace architecture examples discussed above, routing the lace cable through the lace guides is most easily accomplish before adhering the lace guides to the footwear upper (not to say it cannot be accomplished later). Open channel lace guides facilitate simple lace routing by allowing the lace cable to simply be pushed pass the lace retainer 820 after the lace guides 800 are positioned on the footwear upper. The lacing guide 800 can be fabricated from various materials including metal or plastics.

Figure 8A:
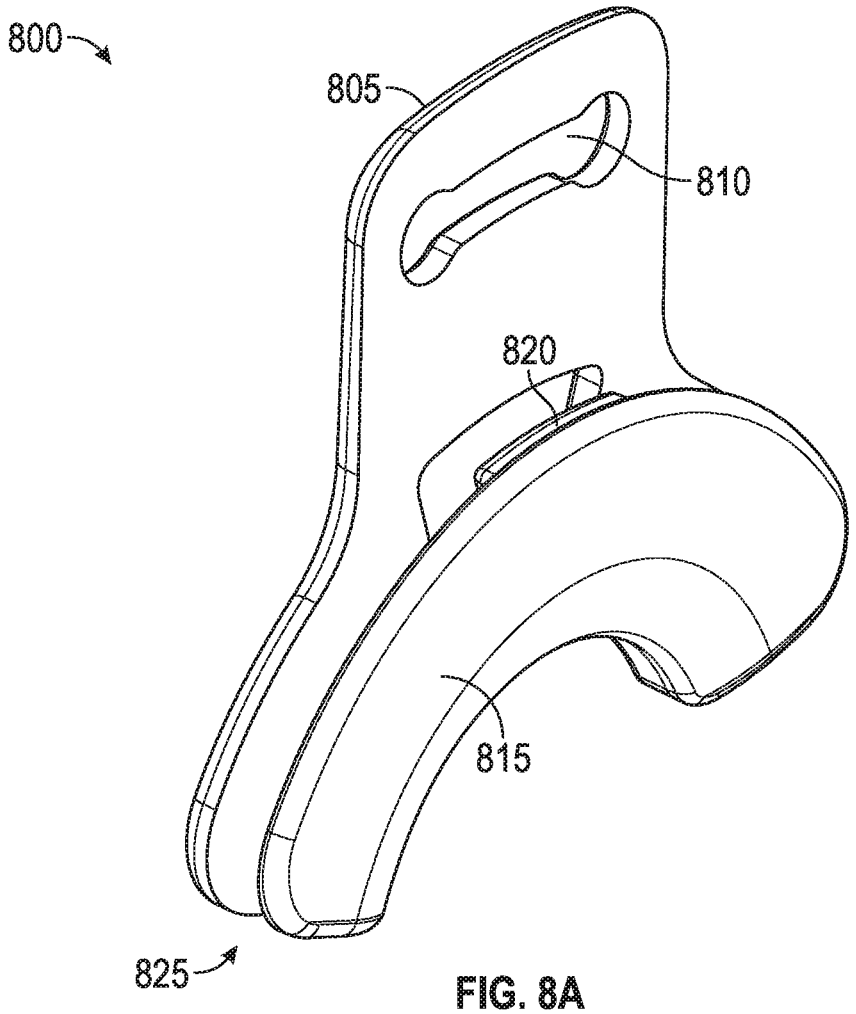
FIGS. 8A-8G are diagrams illustrating a lacing guide for use in certain lacing architectures, according to some example embodiments.
Figure 8B:
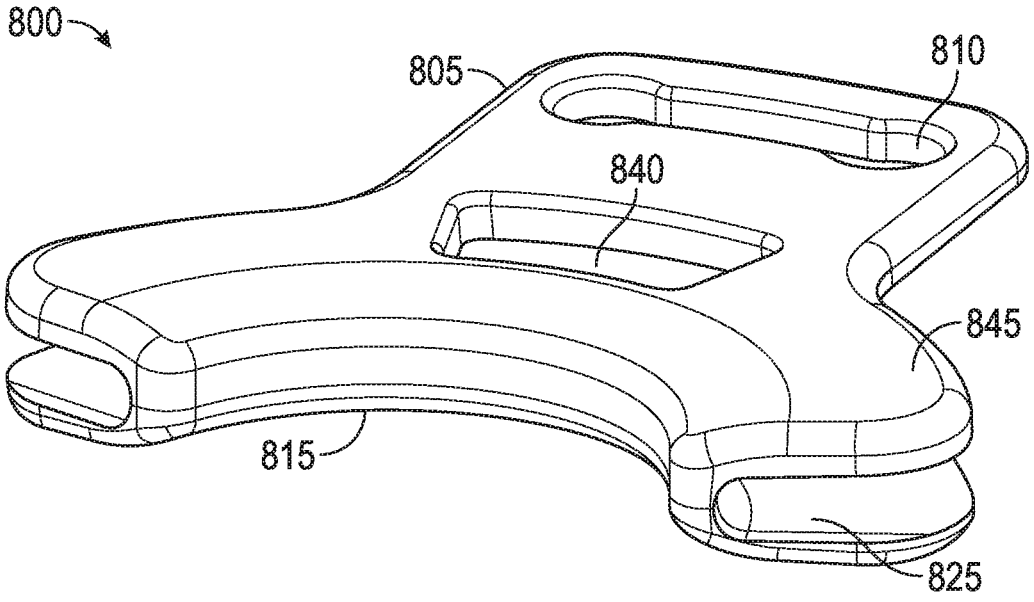
Figure 8C:
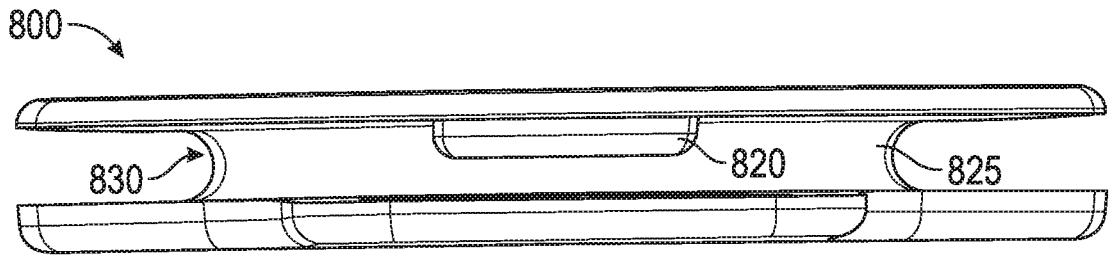
Figure 8D:
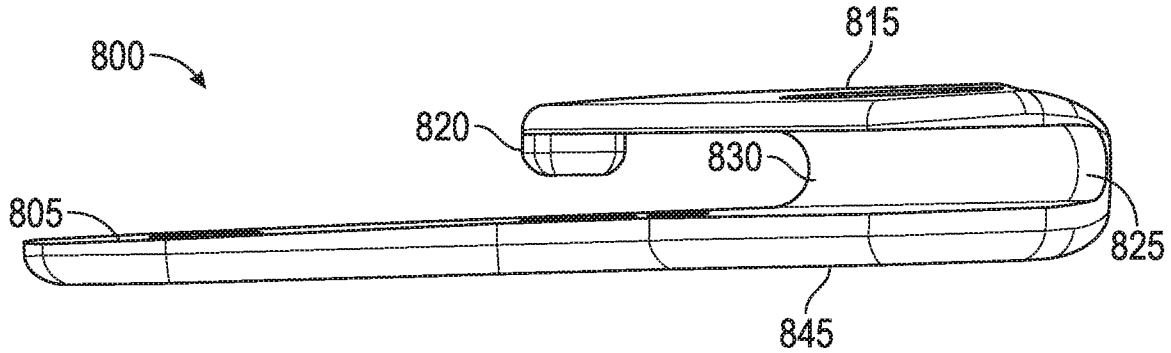
Figure 8E:
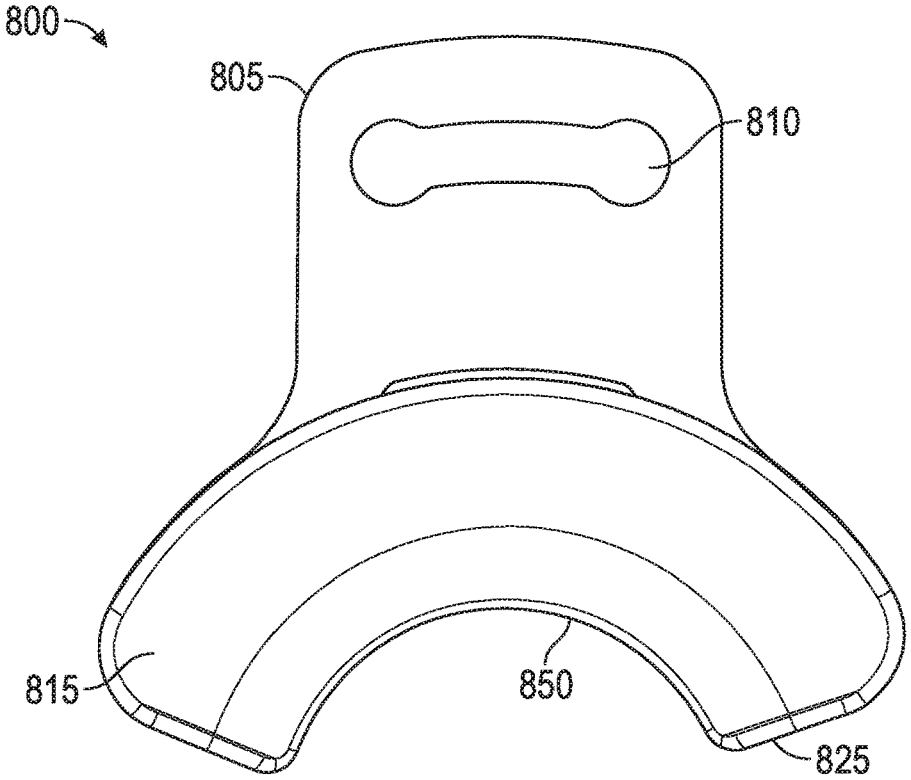
Figure 8F:
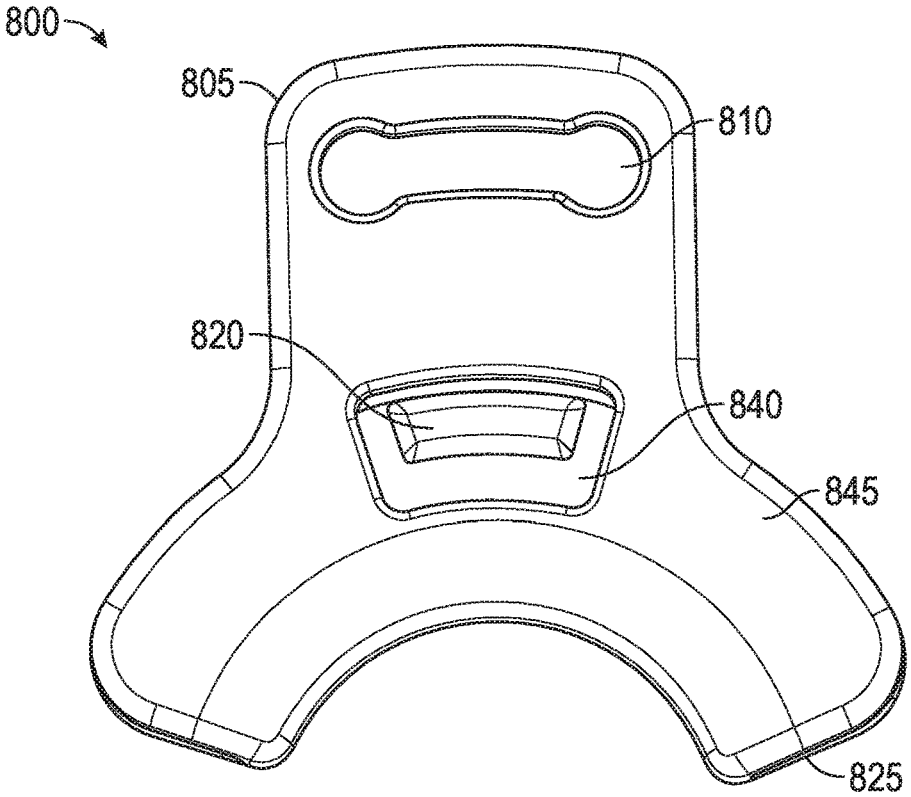

In this example, the lacing guide 800 can be initially attached to a footwear upper through stitching or adhesives. The illustrated design includes a stitch opening 810 that is configured to enable easy manual or automated stitching of lacing guide 800 onto a footwear upper (or similar material). Once lacing guide 800 is attached to the footwear upper, lace cable can be routed by simply pulling a loop of lace cable into the lace channel 825. The lace access opening 840 extends through the inferior surface 845 to provide a relief recess for the lace cable to get around the lace retainer 820. In some examples, the lace retainer 820 can be different dimensions or even be split into multiple smaller protrusions. In an example, the lace retainer 820 can be narrower in width, but extend further towards or even into access opening 840. In some examples, the access opening 840 can also be different dimensions, and will usually somewhat mirror the shape of lace retainer 820 (as illustrated in FIG. 8F). In this example, the channel radius 830 is designed to correspond to, or be slightly larger then, the diameter of the lace cable. The channel radius 830 is one of the parameters of the lacing guide 800 that can control the amount of friction experienced by the lace cable running through the lacing guide 800. Another parameter of lacing guide 800 that impacts friction experienced by the lace cable includes guide radius 850. The guide radius 850 also may impact the frequency or spacing of lace guides positioned on a footwear upper.

Figure 8G:
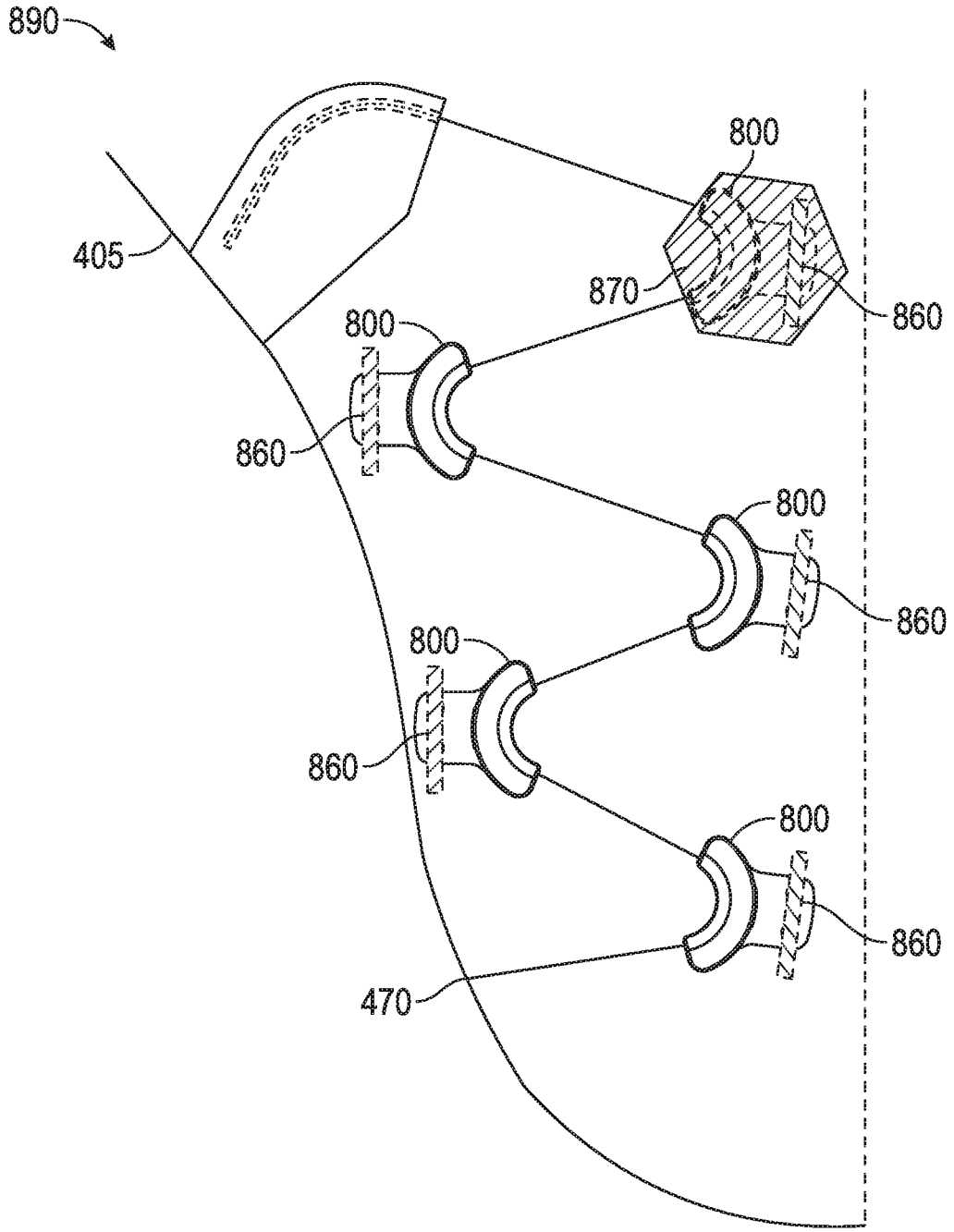

FIG. 8G is a diagram illustrating a portion of footwear upper 405 with a lacing architecture 890 using lacing guides 800, according to some example embodiments. In this example, multiple lacing guides 800 are arranged on a lateral side of footwear upper 405 to form half of the lacing architecture 890. Similar to lacing architectures discussed above, lacing architecture 890 uses lacing guides 800 to form a wave pattern or parachute lacing pattern to route the lace cable. One of the benefits of this type of lacing architecture is that lace tightening can produce both later-medial tightening as well as anterior-posterior tightening of the footwear upper 405.

In this example, lacing guides 800 are at least initially adhered to upper 405 through stitching 860. The stitching 860 is shown over or engaging stitch opening 810. One of the lacing guide 800 is also depicted with a reinforcement 870 covering the lacing guide. Such reinforcements can be positioned individually over each of the lacing guides 800. Alternatively, larger reinforcements could be used to cover multiple lacing guides. Similar to the reinforcements discussed above, reinforcement 870 can be adhered through adhesives, heat-activated adhesives, and/or stitching. In some examples, reinforcement 870 can be adhered using adhesives (heat-activated or not) and a vacuum bagging process that uniformly compresses the reinforcement over the lacing guide. A similar vacuum bagging process can also be used with reinforcements and lacing guides discussed above. In other examples, mechanical presses or similar machines can be used to assist with adhering reinforcements over lacing guides.

Once all of the lacing guides 800 are initially positioned and attached to footwear upper 405, the lace cable can be routed through the lacing guides. Lace cable routing can begin with anchoring a first end of the lace cable at lateral anchor point 470. The lace cable can then be pulled into each lace channel 825 starting with the anterior most lacing guide and working posteriorly towards the heel of upper 405. Once the lace cable is routed through all lacing guides 800, reinforcements 870 can be optionally adhered over each of the lacing guides 800 to secure both the lacing guides and the lace cable.

Assembly Processes

Figure 9:
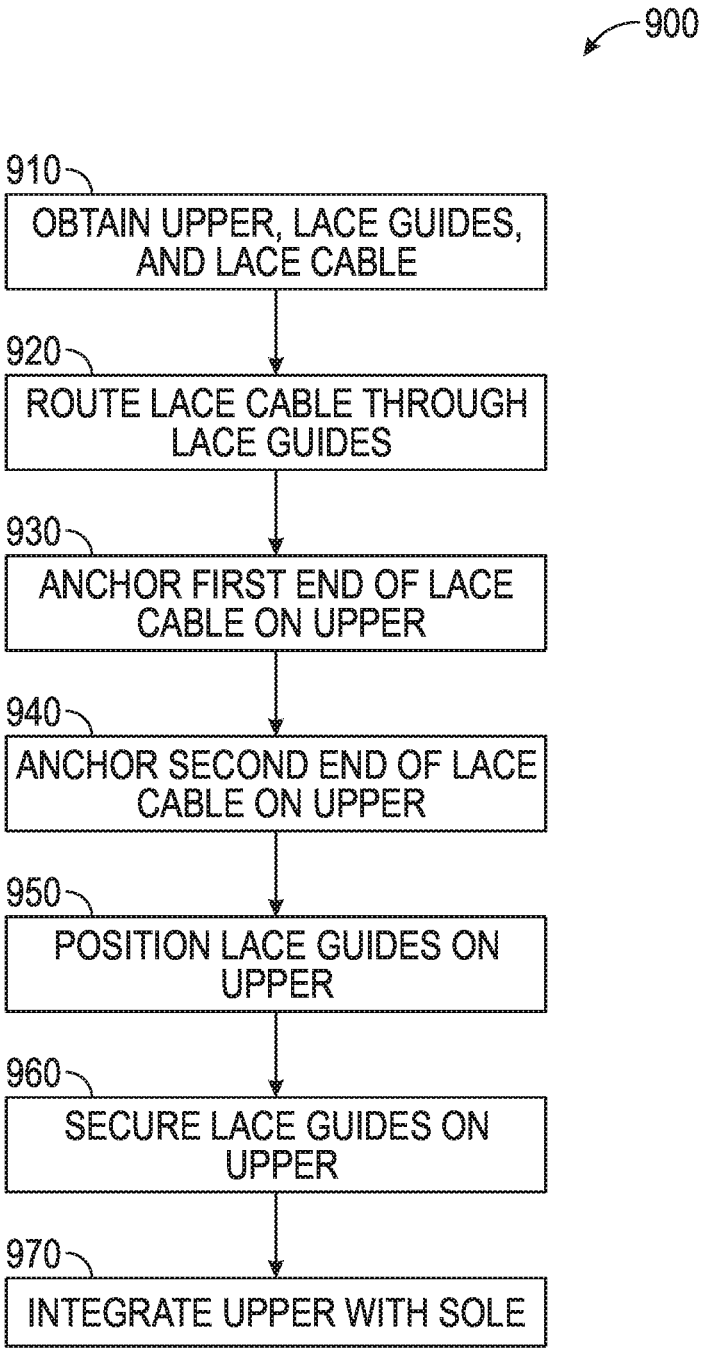
FIG. 9 is a flowchart illustrating a footwear assembly process for assembly of footwear including a lacing engine, according to some example embodiments.

FIG. 9 is a flowchart illustrating a footwear assembly process 900 for assembly of footwear including a lacing engine, according to some example embodiments. In this example, the assembly process 900 includes operations such as: obtaining footwear upper, lace guides, and lace cable at 910; routing lace cable through tubular lace guides at 920; anchoring a first end of the lace cable at 930; anchoring a second end of lace cable at 940; positioning lace guides at 950; securing lace guides at 960; and integrating upper with footwear assembly at 970. The process 900 described in further detail below can include some or all of the process operations described and at least some of the process operations can occur at various locations and/or using different automated tools.

In this example, the process 900 begins at 910 by obtaining a footwear upper, a plurality of lace guides, and a lace cable. The footwear upper, such as upper 405, can be a flattened footwear upper separated from the remainder of a footwear assembly (e.g., sole, mid-sole, outer cover, etc. . . . ). The lace guides in this example include tubular plastic lace guides as discussed above, but could also include other types of lace guides. At 920, the process 900 continues with the lace cable being routed (or threaded) through the plurality of lace guides. While the lace cable can be routed through the lace guides at a different point in the assembly process 900, when using tubular lace guides routing the lace through the lace guides prior to assembly onto the footwear upper may be preferable. In some examples, the lace guides can be pre-threaded onto the lace cable, with process 900 beginning with multiple lace guides already threaded onto the lace obtained during the operation at 910.

At 930, the process 900 continues with a first end of the lace cable being anchored to the footwear tipper. For example, lace cable 430 can be anchored along a lateral edge of upper 405. In some examples, the lace cable may be temporary anchored to the upper 405 with a more permanent anchor accomplished during integration of the footwear upper with the remaining footwear assembly. At 940, the process 900 can continue with a second end of the lace cable being anchored to the footwear upper. Like the first end of the lace cable, the second end can be temporarily anchored to the upper. Additionally, the process 900 can optionally delay anchoring of the second end until later in the process or during integration with the footwear assembly.

At 950, the process 900 continues with the plurality of lace guides being positioned on the upper. For example, lace guides 410 can be positioned on upper 405 to generate the desired lacing pattern. Once the lace guides are positioned, the process 900 can continue at 960 by securing the lace guides onto the footwear upper. For example, the reinforcements 420 can be secured over lace guides 410 to hold them in position. Finally, the process 900 can complete at 970 with the footwear upper being integrated into the remainder of the footwear assembly, including the sole. In an example, integration can include positioning the loop of lace cable connecting the lateral and medial sides of the footwear upper in position to engage a lacing engine in a mid-sole of the footwear assembly.

Figure 10:
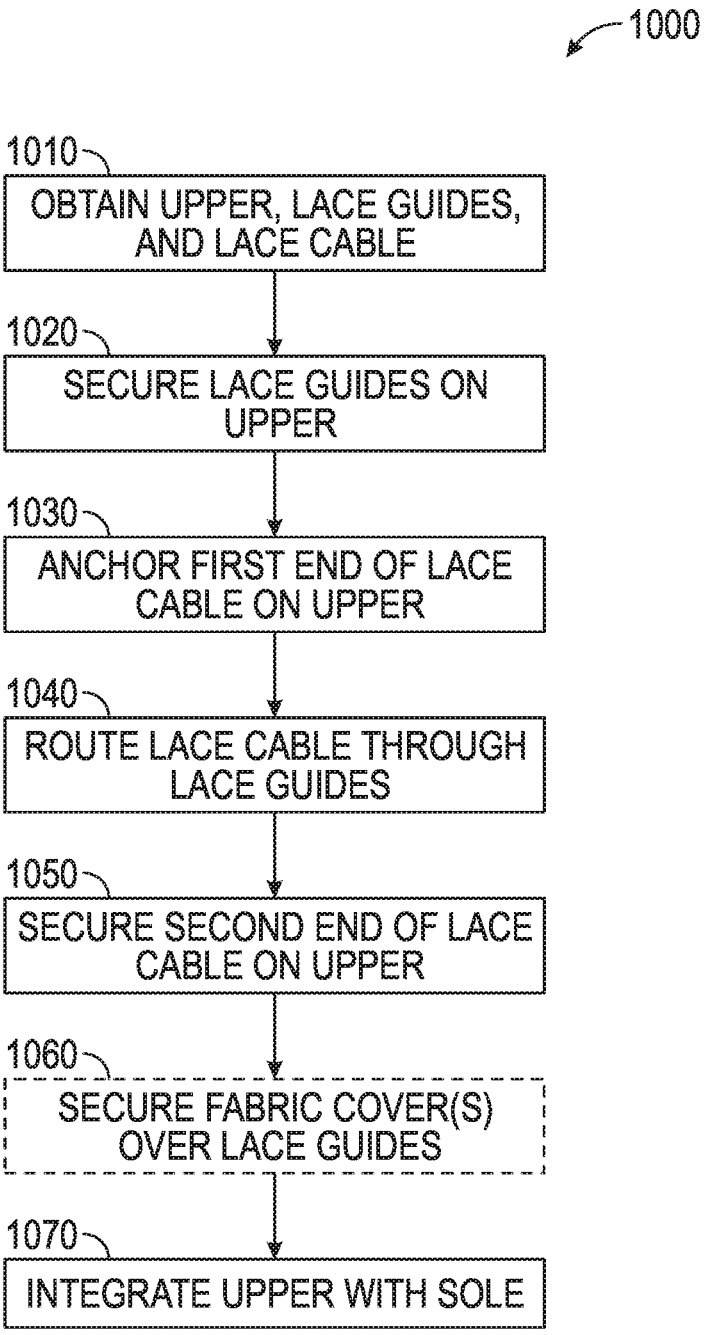
FIG. 10 is a flowchart illustrating a footwear assembly process for assembly of footwear including a lacing engine, according to some example embodiments.

FIG. 10 is a flowchart illustrating a footwear assembly process 1000 for assembly of footwear including a plurality of lacing guides, according to some example embodiments. In this example, the assembly process 1000 includes operations such as: obtaining footwear upper, lace guides, and lace cable at 1010; securing lacing guides on footwear upper at 1020; anchoring a first end of the lace cable at 1030; routing lace cable through the lace guides at 1040; anchoring a second end of lace cable at 1050; optionally securing reinforcements over the lace guides at 1060; and integrating upper with footwear assembly at 1070. The process 1000 described in further detail below can include some or all of the process operations described and at least some of the process operations can occur at various locations and/or using different automated tools.

In this example, the process 1000 begins at 1010 by obtaining a footwear upper, a plurality of lace guides, and a lace cable. The footwear upper, such as upper 405, can be a flattened footwear upper separated from the remainder of a footwear assembly (e.g., sole, mid-sole, outer cover, etc. . . . ). The lace guides in this example include open channel plastic lacing guides as discussed above, but could also include other types of lace guides. At 1020, the process 1000 continues with the lacing guides being secured to the upper. For example, lacing guides 800 can be individually stitched in position on upper 405.

At 1030, the process 1000 continues with a first end of the lace cable being anchored to the footwear upper. For example, lace cable 430 can be anchored along a lateral edge of upper 405. In some examples, the lace cable may be temporary anchored to the upper 405 with a more permanent anchor accomplished during integration of the footwear upper with the remaining footwear assembly. At 1040, the process 1000 continues with the lace cable being routed through the open channel lace guides, which includes leaving a lace loop for engagement with a lacing engine between the lateral and medial sides of the footwear upper. The lace loop can be a predetermined length to ensure the lacing engine is able to properly tighten the assembled footwear.

At 1050, the process 1000 can continue with a second end of the lace cable being anchored to the footwear upper. Like the first end of the lace cable, the second end can be temporarily anchored to the upper. Additionally, the process 1000 can optionally delay anchoring of the second end until later in the process or during integration with the footwear assembly. In certain examples, delaying anchoring of the first and/or second end of the lace cable can allow for adjustment in overall lace length, which may be useful during integration of the lacing engine.

At 1060, the process 1000 can optionally include an operation for securing fabric reinforcements (covers) over the lace guides to further secure them to the footwear upper. For example, lacing guides 800 can have reinforcements 870 hot melted over the lacing guides to further secure the lacing guides and the lace cable. Finally, the process 1000 can complete at 1070 with the footwear upper being integrated into the remainder of the footwear assembly, including the sole. In an example, integration can include positioning the loop of lace cable connecting the lateral and medial sides of the footwear upper in position to engage a lacing engine in a mid-sole of the footwear assembly.

Examples

The present inventors have recognized, among other things, a need for an improved lacing architecture for automated and semi-automated tightening of shoe laces. This document describes, among other things, example lacing architectures, example lace guides used in the lacing architectures, and related assembly techniques for automated footwear platforms. The following examples provide a non-limiting examples of the actuator and footwear assembly discussed herein.

Example 1 describes subject matter including a footwear assembly with a lacing architecture to facilitate automated tightening. In this example, the footwear assembly can include a footwear upper including a toe box portion, a medial side, a lateral side, and a heel portion, the medial side and the lateral side each extending proximally from the toe box portion to a heel portion. The footwear assembly can also include a lace cable running through a plurality of lace guides. The lace cable can include a first end anchored along a distal outside portion of the medial side and a second end anchored along a distal outside portion of the lateral side. The plurality of lace guides can be distributed along the medial side and the lateral side, and each lace guide of the plurality of lace guides can be adapted to receive a length of the lace cable. In this example, the lace cable can extend through each of the plurality of lace guides to form a pattern along each of the medial side and lateral side of the footwear upper. The footwear assembly can also include a medial proximal lace guide routing the lace cable from the pattern formed by a medial portion of the plurality of lace guides into a position allowing the lace cable to engage a lacing engine disposed within a mid-sole portion. Finally, the footwear assembly includes a lateral proximal lace guide to route the lace cable out of the position allowing the lace cable to engage the lacing engine into the pattern formed by a lateral portion of the plurality of lace guides.

In example 2, the subject matter of example 1 can optionally include each lace guide of the plurality of lace guides forming a u-shaped channel to retain the lace cable.

In example 3, the subject matter of example 2 can optionally include the u-shaped channel in each lace guide is an open channel allowing a lace loop to be pulled into the lace guide.

In example 4, the subject matter of example 2 can optionally include the u-shaped channel in each lace guide being formed with a tubular structure bent or formed in a u-shape with the lace cable threaded through the tubular structure.

In example 5, the subject matter of any one of examples 1 to 4 can optionally include the pattern being shaped to flatten a force or torque verses lace displacement curve during tightening of the lace cable.

In example 6, the subject matter of any one of examples 1 to 5 can optionally include each lace guide of the plurality of lace guides being secured to the footwear upper with an overlay including heat-activated adhesive compressed over each lace guide.

In example 7, the subject matter of example 6 can optionally include the overlay being a fabric impregnated with the heat-activated adhesive.

In example 8, the subject matter of example 6 can optionally include portions of each lace guide extending beyond the overlay securing each lace guide.

In example 9, the subject matter of any one of examples 1 to 8 can optionally include each lace guide of the plurality of lace guides being at least initially secured to the footwear upper by stitching.

In example 10, the subject matter of example 9 can optionally include each lace guide of the plurality of lace guides being further secured to the footwear upper with an overlay including heat-activated adhesive compressed over each lace guide.

In example 11, the subject matter of any one of examples 1 to 10 can optionally include the pattern formed with the lace guides creating a substantially sinusoidal wave along each of the medial side and the lateral side of the footwear upper.

In example 12, the subject matter of example 11 can optionally include the substantially sinusoidal wave being a modified sine wave including larger radius curves at crests and troughs in comparison to a standard sine wave.

In example 13, the subject matter of any one of examples 1 to 12 can optionally include the pattern including three upper lace guides proximate the centerline of the footwear upper on each of the medial side and the lateral side.

In example 14, the subject matter of example 13 can optionally include each of the three upper lace guides on each of the medial side and the lateral side being spaced a different distance from the centerline.

In example 15, the subject matter of any one of examples 1 to 14 can optionally include the footwear upper having an elastic centerline portion extending from at least the toe box portion proximally to a foot opening.

In example 16, the subject matter of any one of examples 1 to 15 can optionally include pairs of lace guides being connected across a centerline portion of the footwear upper by elastic members.

In example 17, the subject matter of example 16 can optionally include the elastic members being adapted to smooth out a torque versus lace displacement curve during tightening of the lace cable.

In example 18, the subject matter of example 16 can optionally include the elastic members being interchangeable with different elastic members providing varying modulus of elasticity to change fit characteristics of the footwear upper.

In example 19, the subject matter of any one of examples 1 to 18 can optionally include the footwear upper including a zipper extending from the toe box portion to a foot opening between a medial portion of the plurality of lace guides and a lateral portion of the plurality of lace guides.

In example 20, the subject matter of any one of examples 1 to 19 can optionally include the pattern preventing the lace cable from crossing over a central portion of the footwear upper between the medial side and the lateral side.

Example 21 describes subject matter including a footwear assembly with a lacing architecture to facilitate automated tightening. In this example, the lacing architecture for an automated footwear platform can include a lace cable routed through a plurality of lace guides. The lace cable can include a first end anchored along a distal outside portion of a medial side of an upper portion of a footwear assembly and a second end anchored along a distal outside portion of a lateral side of the upper portion. The plurality of lace guides can be distributed in a first pattern along the medial side and in a second pattern along the lateral side. Additionally, each lace guide of the plurality of lace guides can include an open lace channel to receive a length of the lace cable. The lacing architecture can also include a medial proximal lace guide for routing the lace cable from the first pattern formed by a medial portion of the plurality of lace guides into a position allowing the lace cable to engage a lacing engine disposed within a mid-sole portion. Finally, in this example, the lacing architecture can also include a lateral proximal lace guide to route the lace cable out of the position allowing the lace cable to engage the lacing engine into the second pattern formed by a lateral portion of the plurality lace guides.

In example 22, the subject matter of example 21 can optionally include each lace guide of the plurality of lace guides including a lace retention member extending into the open lace channel to assist in retaining the lace cable within the lace guide.

In example 23, the subject matter of example 22 can optionally include each lace guide of the plurality of lace guides having a lace access opening opposite the lace retention member, the lace access opening providing clearance to route the cable around the lace retention member.

In example 24, the subject matter of any one of examples 21 to 23 can optionally include each lace guide of the plurality of lace guides having a stitch opening along a superior portion of the lace guide, the stitch opening enabling the lace guide to be at least partially secure to the upper portion by stitching.

Additional Notes

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The disclosure, therefore, is not to be taken in a limiting sense, and the scope of various embodiments includes the full range of equivalents to which the disclosed subject matter is entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method (process) examples described herein, such as the footwear assembly examples, can include machine or robotic implementations at least in part.

The above description is intended to be illustrative, and not restrictive. For example, the above-described examples (or one or more aspects thereof) may be used in combination with each other. Other embodiments can be used, such as by one of ordinary skill in the art upon reviewing the above description. An Abstract, if provided, is included to comply with 37 C.F.R. § 1.72(b), to allow the reader to quickly ascertain the nature of the technical disclosure. It is submitted with the understanding that it will not be used to interpret or limit the scope or meaning of the claims. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention includes:

1. A lacing architecture for an automated footwear platform, the lacing architecture comprising:

a lace cable with a first end anchored along a distal outside portion of a medial side of an upper portion of the footwear platform and a second end anchored along a distal outside portion of a lateral side of the upper portion;

a plurality of lace guides distributed in a first pattern along the medial side and in a second pattern along the lateral side, each lace guide of the plurality of lace guides receiving a length of the lace cable, wherein at least a portion of the medial side is separated from at least a portion of the lateral side by an open central portion; and a reinforcement fabric coupling at least one medial side lace guide with a corresponding lateral side lace guide across the open central portion.

2. The lacing architecture of claim 1, wherein each lace guide of the plurality of lace guides forms a u-shaped channel to retain the lace cable.

3. The lacing architecture of claim 2, wherein the u-shaped channel in each lace guide is an open channel allowing a lace loop to be pulled into the lace guide.

4. The lacing architecture of claim 2, wherein the u-shaped channel in each lace guide is formed with a tubular structure bent or formed in a u-shape with the lace cable threaded through the tubular structure.

5. The lacing architecture of claim 4, wherein the tubular structure is adapted to flatten a force or torque verses lace displacement curve during tightening of the lace cable.

6. The lacing architecture of claim 1, wherein each lace guide of the plurality of lace guides is secured to the upper portion with an overlay including heat-activated adhesive compressed over each lace guide.

7. The lacing architecture of claim 6, wherein the overlay is a fabric impregnated with the heat-activated adhesive.

8. The lacing architecture of claim 1, wherein each lace guide of the plurality of lace guides is at least initially secured to the upper portion by stitching.

9. The lacing architecture of claim 8, wherein each lace guide of the plurality of lace guides is further secured to the upper portion with an overlay including heat-activated adhesive compressed over each lace guide.

10. The lacing architecture of claim 1, wherein the first pattern and the second pattern each include three upper lace guides proximate a centerline of the footwear upper on each of the medial side and the lateral side respectively.

11. The lacing architecture of claim 10, wherein each of the three upper lace guides on each of the medial side and the lateral side are spaced a different distance from the centerline.

12. The lacing architecture of claim 1, wherein the reinforcement fabric includes an elastic centerline portion extending from at least a toe box portion proximally to a foot opening.

13. The lacing architecture of claim 1, wherein the reinforcement fabric couples pairs of lace guides across the open central portion of the footwear upper by elastic fabric.

14. The lacing architecture of claim 12, wherein the elastic fabric functions to smooth out a torque versus lace displacement curve during tightening of the lace cable.

15. The lacing architecture of claim 1, wherein the reinforcement fabric is interchangeable with different reinforcement fabrics providing varying modulus of elasticity to change fit characteristics of the footwear upper.

16. The lacing architecture of claim 1, wherein the upper portion includes a zipper extending from a toe box portion to a foot opening between a medial portion of the plurality of lace guides and a lateral portion of the plurality of lace guides.

17. The lacing architecture of claim 1, wherein the lace cable is routed under the upper portion to engage a lacing engine disposed within an inferior portion of the footwear platform.

18. A lacing architecture for a footwear assembly, the lacing architecture comprising:

a lace cable with a first end anchored along a distal outside portion of a medial side of an upper portion of the footwear assembly and a second end anchored along a distal outside portion of a lateral side of the upper portion, the lace cable routed under the upper portion to engage a lacing engine disposed within an inferior portion of the footwear assembly;

a plurality of lace guides distributed in a first pattern along the medial side and in a second pattern along the lateral side, each lace guide of the plurality of lace guides receiving a length of the lace cable, wherein at least a portion of the medial side is separated from at least a portion of the lateral side by an open central portion; and a fabric reinforcement member coupling at least one medial side lace guide with a corresponding lateral side lace guide across the open central portion.

19. The footwear assembly of claim 18, wherein the fabric reinforcement member couples pairs of lace guides across the open central portion of the footwear upper by elastic members.

20. The footwear assembly of claim 18, wherein the fabric reinforcement member is interchangeable with different reinforcement members providing varying modulus of elasticity to change fit characteristics of the footwear upper.

* * * * *